US007880689B2

(12) United States Patent
Kishi et al.

(10) Patent No.: US 7,880,689 B2
(45) Date of Patent: Feb. 1, 2011

(54) DRIVE CIRCUIT

(75) Inventors: Tomokatsu Kishi, Kawasaki (JP); Tetsuya Sakamoto, Kawasaki (JP); Akihiro Takagi, Kawasaki (JP); Satoru Nishimura, Kawasaki (JP); Yoshikazu Kanazawa, Kawasaki (JP); Takayuki Kobayashi, Kawasaki (JP); Takashi Sasaki, Kawasaki (JP); Yasunobu Hashimoto, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 1600 days.

(21) Appl. No.: 11/181,793

(22) Filed: Jul. 15, 2005

(65) Prior Publication Data

US 2006/0012545 A1 Jan. 19, 2006

(30) Foreign Application Priority Data

Jul. 15, 2004 (JP) ..... 2004-208379

(51) Int. Cl.
*G09G 3/28* (2006.01)

(52) U.S. Cl. ..... 345/60; 315/169.4

(58) Field of Classification Search ..... 345/60, 345/211; 315/169.1–169.4
See application file for complete search history.

(56) References Cited

U.S. PATENT DOCUMENTS

| | | | | |
|---|---|---|---|---|
| 5,994,929 | A | 11/1999 | Sano et al. | |
| 6,100,859 | A | 8/2000 | Kuriyama et al. | |
| 6,686,912 | B1 * | 2/2004 | Kishi et al. | 345/211 |
| 7,145,522 | B2 | 12/2006 | Yamamoto et al. | |
| 7,242,373 | B2 * | 7/2007 | Tomio et al. | 345/60 |
| 2004/0085305 | A1 | 5/2004 | Kunii et al. | |
| 2004/0135746 | A1 * | 7/2004 | Lee et al. | 345/60 |

FOREIGN PATENT DOCUMENTS

| | | |
|---|---|---|
| CN | 1573856 | 2/2005 |
| EP | 1 416 465 | 5/2004 |
| JP | 2004-151348 | 5/2004 |
| KR | 1998-081751 | 11/1998 |

OTHER PUBLICATIONS

Korean Office Action issued in Korean Application No. 10-2005-37558 dated Aug. 29, 2006.
Office Action issued in corresponding Chinese Patent Application No. 200510068367.8, on Aug. 31, 2007.
Office Action issued Oct. 9, 2008 in corresponding Taiwanese Patent Application No. 94111316.
Japanese Office Action mailed Feb. 2, 2010 in corresponding Japanese Patent Application 2004-208379.

* cited by examiner

*Primary Examiner*—Quan-Zhen Wang
*Assistant Examiner*—Yuk Chow
(74) *Attorney, Agent, or Firm*—Staas & Halsey LLP

(57) ABSTRACT

There is provided a drive circuit of a display device using a capacitive load which includes a clamp circuit connected to a power source potential and clamping a potential of the capacitive load to the power source potential such that an electric power is supplied to the capacitive load in a temporally dispersed manner. For example, the clamp circuit includes a plurality of switches parallelly connected between the capacitive load and the power source potential, the plurality of switches being turned on at different times.

4 Claims, 20 Drawing Sheets

DRIVE CIRCUIT

CROSS-REFERENCE TO RELATED APPLICATIONS

This application is based upon and claims the benefit of priority from the prior Japanese Patent Application No. 2004-208379, filed on Jul. 15, 2004, the entire contents of which are incorporated herein by reference.

BACKGROUND OF THE INVENTION

1. Field of the Invention

The present invention relates to a drive circuit, particularly to the drive circuit of a display device using a capacitive load.

2. Description of the Related Art

FIG. 18 is a diagram showing a basic structure of a plasma display panel device. A control circuit unit 1801 controls an address driver 1802, a common electrode (X electrode) sustain circuit 1803, a scan electrode (Y electrode) sustain circuit 1804, and a scan driver 1805.

The address driver 1802 supplies a predetermined voltage to address electrodes A1, A2, A3, . . . . Hereinafter, the address electrodes A1, A2, A3, . . . are referred to individually or collectively as an address electrode Aj, the j meaning a subscript.

The scan driver 1805 supplies a predetermined voltage to Y electrodes Y1, Y2, Y3, . . . , in accordance with controls of the control circuit unit 1801 and the Y electrode sustain circuit 1804. Hereinafter, the Y electrodes Y1, Y2, Y3, . . . are referred to individually or collectively as a Y electrode Yi, the i meaning a subscript.

The X electrode sustain circuit 1803 supplies the same voltages to X electrodes X1, X2, X3, . . . respectively. Hereinafter, the X electrodes X1, X2, X3, . . . are referred to individually or collectively as an X electrode Xi, the i meaning the subscript. The respective X electrodes Xi are connected to each other and have the same voltage level.

In a display region 1807, the Y electrodes Yi and the X electrodes Xi form rows extending parallelly in a horizontal direction, while the address electrodes Aj form columns extending in a vertical direction. The Y electrodes Yi and the X electrodes Xi are arranged alternately in the vertical direction. Ribs 1806 have stripe rib structures placed between the respective address electrodes Aj.

The Y electrode Yi and the address electrode Aj form a two dimensional matrix of row i and column j. A display cell Cij is formed by an intersection point of the Y electrode Yi and the address electrode Aj as well as the adjacent X electrode Xi corresponding thereto. This display cell Cij corresponds to a pixel, and the display region 1807 can display a two dimensional image.

FIG. 19A is a view showing a cross-sectional structure of the display cell Cij in FIG. 18. The X electrode Xi and the Y electrode Yi are formed on a front glass substrate 1911. Thereon, there is deposited a dielectric layer 1912 for insulating against a discharge space 1917, and further thereon there is deposited an MgO (magnesium oxide) protective film 1913.

Meanwhile, the address electrode Aj is formed on a rear glass substrate 1914 disposed opposing to the front glass substrate 1911, thereon a dielectric layer 1915 is deposited, and further thereon a phosphor is deposited. In the discharge space 1917 between the MgO protective film 1913 and the dielectric layer 1915, Ne+Xe Penning gas and the like is sealed.

FIG. 19B is a view explaining a capacitance Cp of an AC plasma display. A capacitance Ca is a capacitance of the discharge space 1917 between the X electrode Xi and the Y electrode Yi. A capacitance Cb is a capacitance of the dielectric layer 1912 between the X electrode Xi and the Y electrode Yi. A capacitance Cc is a capacitance of the front glass substrate 1911 between the X electrode Xi and the scan electrode Yi. A sum of these capacitances Ca, Cb, and Cc determines the capacitance Cp between the electrodes Xi and Yi.

FIG. 19C is a view explaining a light emission of the AC plasma display. On an inner surface of ribs 1916, phosphors 1918 of red, blue, and green are arranged and coated in stripes of respective colors, and the phosphors 1918 are to be exited by a discharge between the X electrode Xi and the Y electrode Yi to generate light 1921.

FIG. 20 is a structural diagram of one frame FR of an image. The image is formed at, for example, 60 frames/second. One frame FR is formed by a first sub frame SF1, a second sub frame SF2, . . . , and a n-th sub frame SFn. The n is for example 10 and corresponds to the number of tone bits. Hereinafter, the sub frames SF1, SF2 and the like are referred to individually or collectively as a sub frame SF.

Each sub frame SF is constituted with a reset period Tr, an address period Ta, and a sustain period (sustained discharge period) Ts. In the reset period Tr, a display cell is initialized. In the address period Ta, each display cell can be selected to be lighted or not lighted by an address discharge between the address electrode Aj and the Y electrode Yi. In the sustain period Ts, a sustain discharge is performed between the X electrode Xi and the Y electrode Yi of the selected display cell and a light emission is carried out. The number of the light emissions (time) by the sustain pulse between the X electrode Xi and the Y electrode Yi are different in the respective SF. Hereby, tone values can be determined.

In the following Patent Document 1, there is described a plasma display device controlling the number of sustain discharges per line in order to prevent a luminance difference between the lines due to a load.

[Patent Document 1] U.S. Pat. No. 6,100,859 (Japanese Patent Application Laid-Open No. Hei 9-68945)

SUMMARY OF THE INVENTION

An object of the present invention is to prevent luminance deterioration caused by an increased load when the number of pixels to be displayed is large.

According to a view of the present invention, there is provided a drive circuit of a display device using a capacitive load which includes a clamp circuit connected to a power source potential and clamping a potential of the capacitive load to the power source potential such that an electric power is supplied to the capacitive load in a temporally dispersed manner.

DETAILED DESCRIPTION OF THE PREFERRED EMBODIMENTS

First Embodiment

Figure 18:
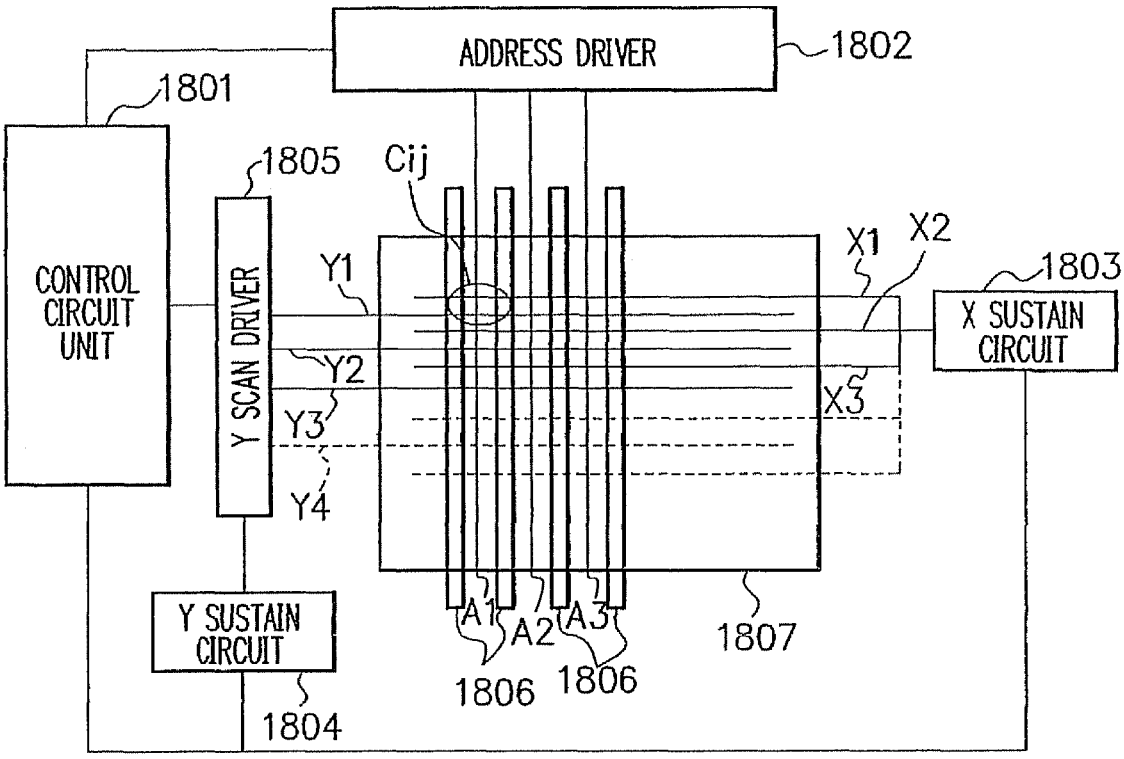
F I G. 18 RELATED ART
FIG. 18 is a diagram showing a basic structure of a plasma display panel device.
Figure 19A:
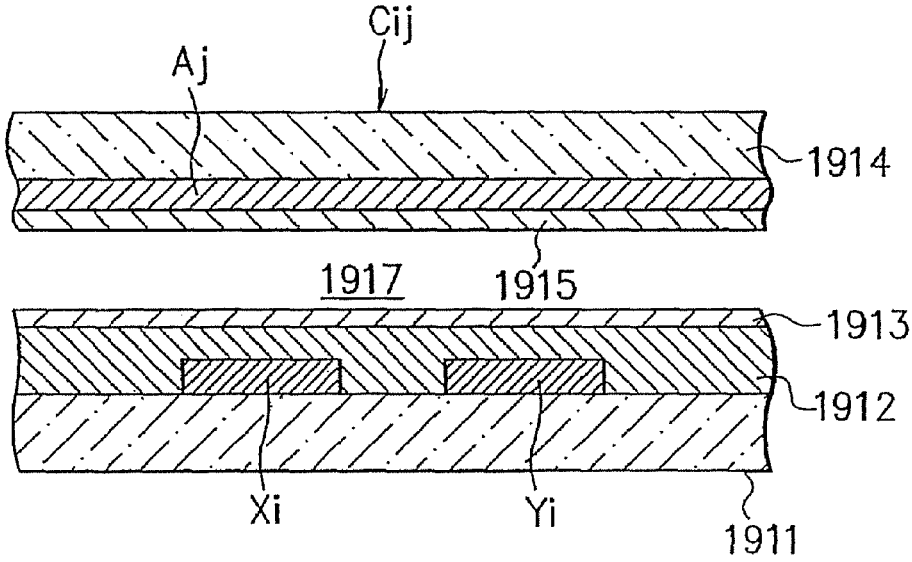
FIG. 19A RELATED ART
FIG. 19A to FIG. 19C are views showing cross-sectional structures of a display cell.
Figure 19B:
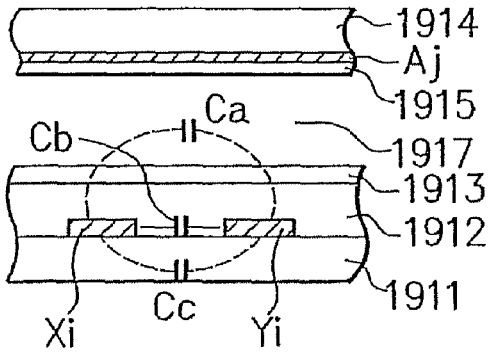
FIG. 19B RELATED ART
Figure 19C:
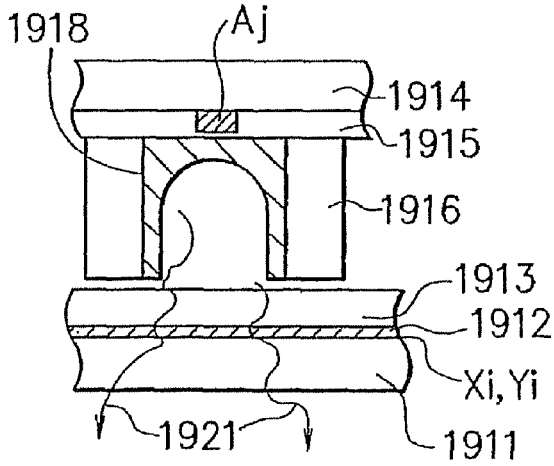
FIG. 19C RELATED ART
Figure 20:
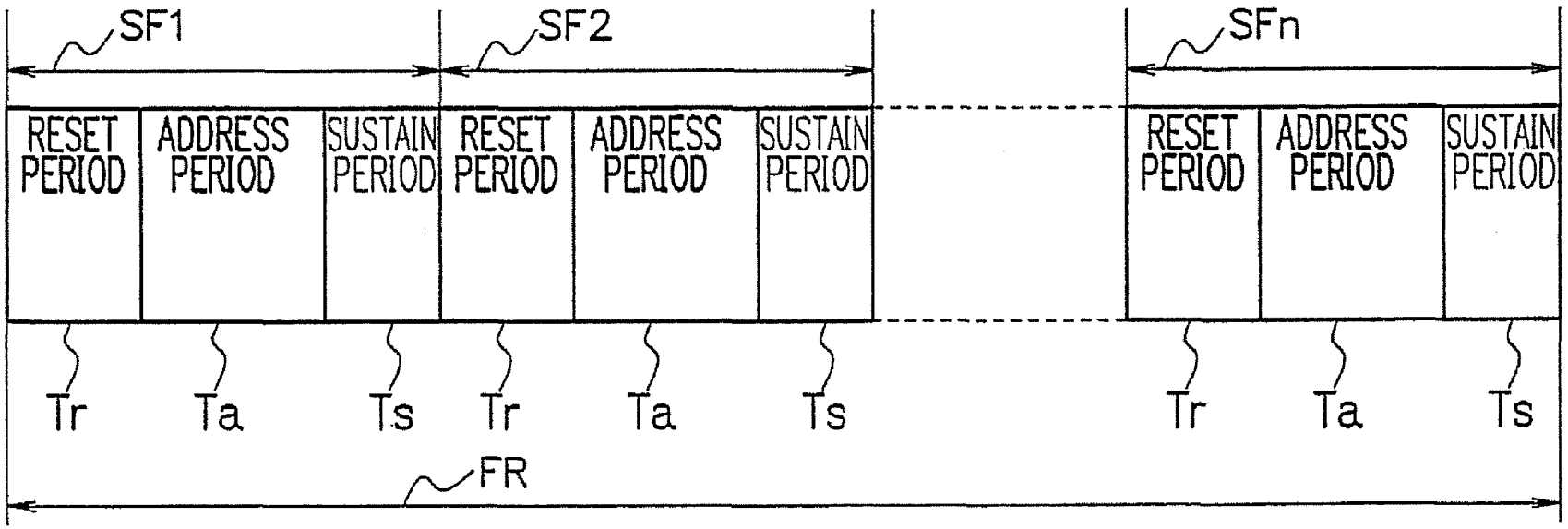
FIG. 20 RELATED ART
FIG. 20 is a structural diagram of one frame of an image.

FIG. 18 is a block diagram showing a structural example of a plasma display device according to a first embodiment of the present invention, FIG. 19A to FIG. 19C are cross-sectional views of a display cell of the plasma display device, and FIG. 20 is a frame structure diagram of an image. Descriptions of these are the same as the above.

Figure 1:
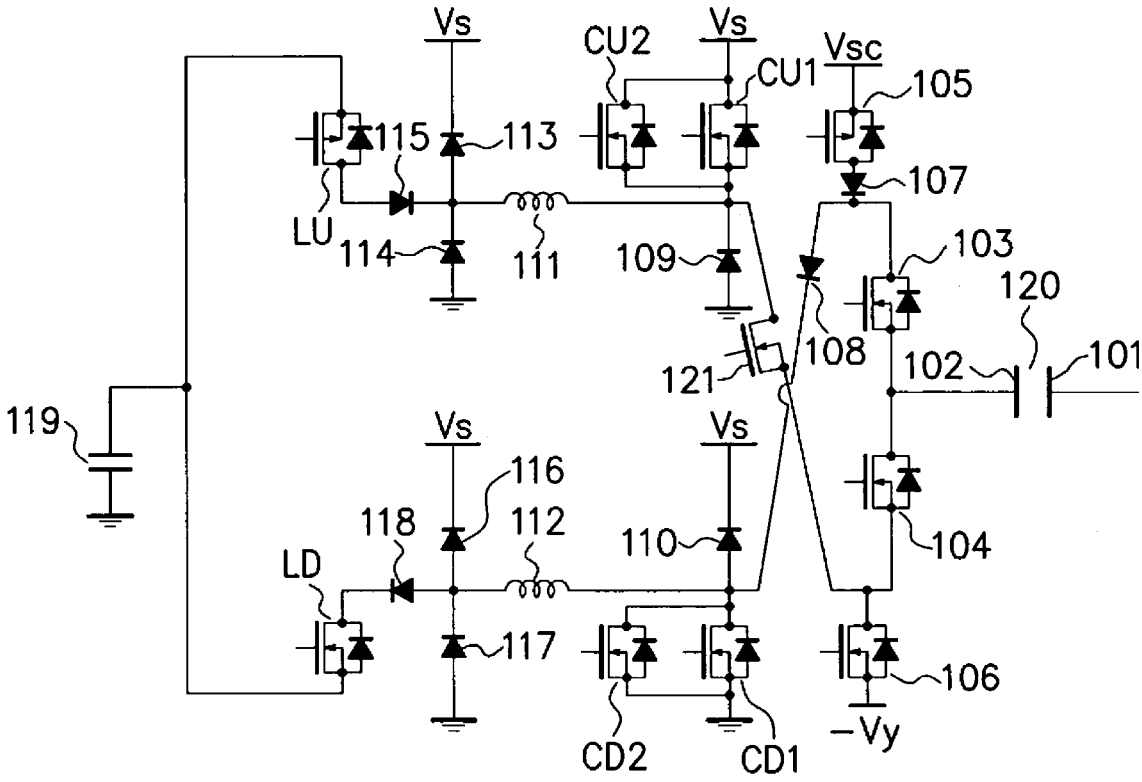
FIG. 1 is a circuit diagram showing a structural example of a Y drive circuit according to a first embodiment of the present invention.

FIG. 1 is a circuit diagram showing a structural example of a Y drive circuit according to the present embodiment. This Y drive circuit corresponds to a Y electrode sustain circuit 1804 and a scan driver 1805 in FIG. 18. An X electrode (first display electrode) 101 and a Y electrode (second display electrode) 102 sandwiches a space insulator therebetween, to form a panel capacitance (capacitive load) 120. A circuit connected to the left of the Y electrode 102 is the Y drive circuit. To the right of the X electrode 101, the X drive circuit is connected. Hereinafter, though the Y drive circuit will be described, the X drive circuit has a similar structure as the structure of the Y drive circuit. Note, however, that the X drive circuit corresponds to an X electrode sustain circuit 1803 in FIG. 18, and does not include transistors 103 and 104, scan operation element 105, 106, and 121, or diodes 107 and 108 which correspond to the scan driver. The transistor 103 is a p-channel MOS field-effect transistor (FET), an n-channel MOSFET, or an IGBT. The transistor 104 is an n-channel MOSFET or an IGBT.

First, a circuit corresponding to the Y electrode sustain circuit 1804 will be described. The Y electrode sustain circuit includes a clamp circuit for clamping and a power recovery circuit for performing an L-C resonance. The n-channel MOSFET 103 has a parasitic diode, and a drain thereof is connected to an anode of the diode 108 and a source thereof is connected to the Y electrode 102. Hereinafter, the MOSFET is simply referred to as a transistor. An n-channel transistor CD1 has a parasitic diode, and a source thereof is connected to ground and a drain thereof is connected to a cathode of the diode 108. An n-channel transistor CD2 also has a parasitic diode, and a source thereof is connected to the ground and a drain thereof is connected the cathode of the diode 108. The transistors CD1 and CD2 are parallelly connected. With regard to a diode 110, an anode is connected to the drains of the transistors CD1 and CD2 while a cathode is connected to a positive potential (power source potential) Vs. A coil 112 is connected between the cathode of the diode 108 and an anode of a diode 118. With regard to a diode 116, an anode is connected to the anode of the diode 118 while a cathode is connected to the positive potential Vs. With regard to a diode 117, an anode is connected to the ground while a cathode is connected to the anode of the diode 118. An n-channel transistor LD has a parasitic diode, and a source thereof is connected to a capacitance 119 while a drain thereof is connected to a cathode of the diode 118.

The n-channel transistor 104 has a parasitic diode, and a drain thereof is connected to the Y electrode 102 while a source thereof is connected to a source of the n-channel transistor 121. A coil 111 is connected between a drain of a transistor 121 and a cathode of a diode 115. An n-channel transistor CU1 has a parasitic diode, and a drain thereof is connected to the positive potential Vs while a source thereof is connected to a drain of a transistor 121. An n-channel transistor CU2 also has a parasitic diode, and a drain thereof is connected to the positive potential Vs while a source thereof is connected to the drain of the transistor 121. The transistors CU1 and CU2 are parallelly connected. With regard to a diode 109, a cathode is connected to the sources of the transistors CU1 and CU2 while an anode is connected to the ground. With regard to a diode 113, an anode is connected to a cathode of a diode 115 while a cathode is connected to the positive potential Vs. With regard to a diode 114, an anode is connected to the ground while a cathode is connected to the cathode of the diode 115. A p-channel transistor LU has a parasitic diode, and a source thereof is connected to the capacitance 119 while a drain thereof is connected to the anode of the diode 115. The capacitance 119 is connected between the sources of transistors LD and LU, and the ground.

Next, a circuit corresponding to the scan driver 1805 will be described. The p-channel transistor 105 has a parasitic diode, and a source thereof is connected to an electric potential Vsc while a drain thereof is connected to an anode of the diode 107. A cathode of the diode 107 is connected to a drain of the transistor 103. The n-channel transistor 106 has a parasitic diode, and a source thereof is connected to a negative potential −Vy while a drain thereof is connected to a source of the transistor 104.

Figure 2:
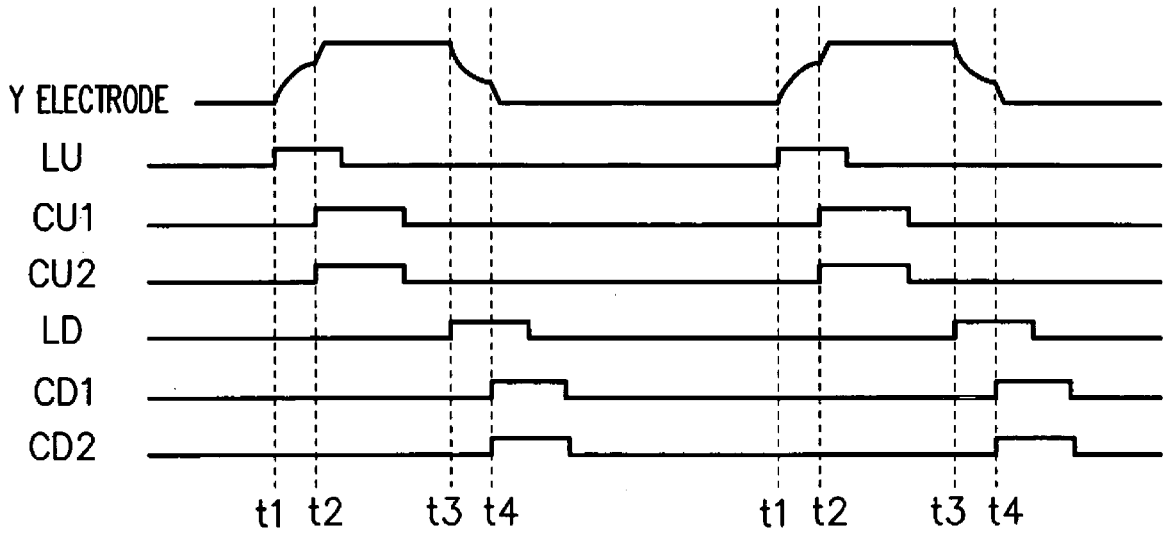
FIG. 2 is a timing chart explaining an operation of a Y electrode sustain circuit.

FIG. 2 is a timing chart explaining an operation of the Y electrode sustain circuit in FIG. 1 during a sustain period Ts in FIG. 20. First, at a time t1, the transistor LU is turned on. Since the capacitance 119 is charged, as will be described later, a voltage of the capacitance 119 is supplied to the Y electrode 102 by the L-C resonance via the transistors LU, 121, and 104. A potential of the Y electrode 102 ascends toward the positive potential Vs.

Next, at a time t2, the transistors CU1 and CU2 are turned on. The positive potential Vs is supplied to the Y electrode 102 via the transistors CU1, CU2, 121, and 104. The potential of the Y electrode 102 is clamped to the positive potential Vs. Later, the transistor Lu is turned off, and the transistors CU1 and CU2 are turned off.

Next, at a time t3, the transistor LD is turned on. An electric charge of the Y electrode 102 is emitted to the capacitance 119 connected to the ground by the L-C resonance via the transistors 103 and LD. The potential of the Y electrode 102 descends toward the ground potential.

Next, at a time t4, the transistors CD1 and CD2 are turned on. The Y electrode 102 is connected to the ground via the transistors 103, CD1, and CD2. The potential of the Y electrode 102 is clamped to the ground potential. Later, the transistor LD is turned off, and the transistors CD1 and CD2 are turned off. Thereafter, the above-described operations of the times t1 to t4 are repeated.

At the time t2, the voltage Vs is applied between the X electrode 101 and the Y electrode 102. A sustain discharge for display between the X electrode 101 and the Y electrode 102 occurs around the time t2. If the transistors CU1 and CU2 are turned on simultaneously at the time t2, a large electric power can be supplied concentratively to the Y electrode 102 and the discharge can be stabilized. Hereinafter, this clamp method is referred to as an electric power concentration clamp.

However, if the electric power supply is concentrated temporally, the following streaking problem arises. When the number of pixels lighted simultaneously in one line is large, a resistance becomes large and the light emission of the lighted pixels becomes dark. In contrast, when the number of the pixels lighted simultaneously in one line is small, the light emission of the lighted pixels becomes comparatively bright. Accordingly, if display is performed at the same tone values, brightness differs according to the lines. The larger this difference is the larger the percentage display of the streaking becomes, which is not desirable. Hereinafter, an embodiment for solving this problem will be described.

Figure 3:
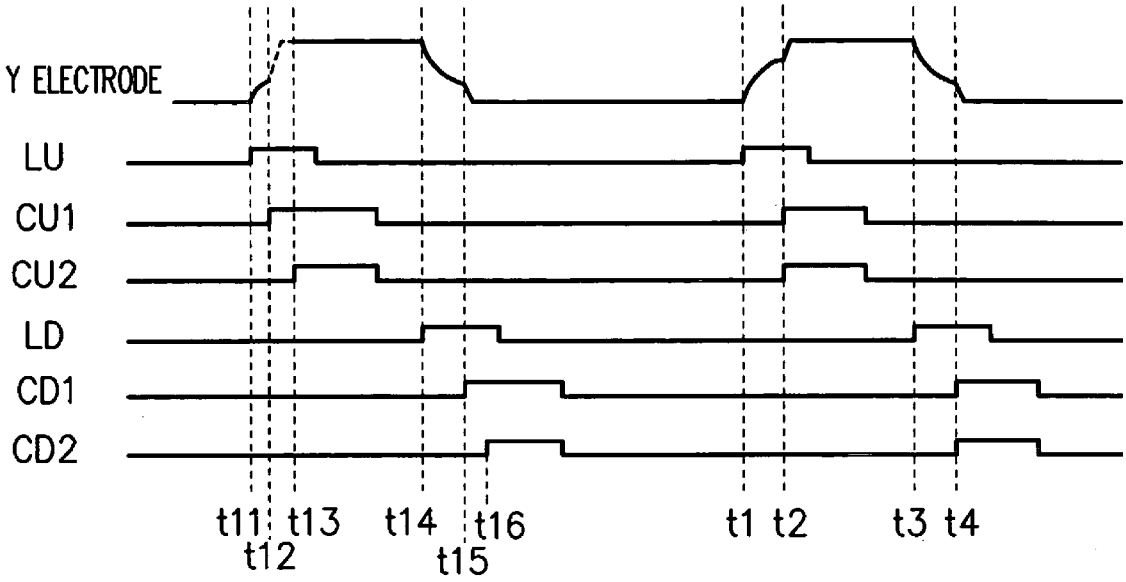
FIG. 3 is a timing chart explaining an operation of a Y electrode sustain circuit according to a first embodiment.

FIG. 3 is a timing chart explaining an operation of the Y electrode sustain circuit in FIG. 1 according to the present embodiment. First, at a time t11, the transistor LU is turned on. The voltage of the capacitance 119 is supplied to the Y electrode 102 by the L-C resonance via the transistors LU, 121, and 104. The potential of the Y electrode 102 ascends toward the positive potential Vs.

Next, at a time t12, the transistor CU1 is turned on. The positive potential Vs is supplied to the Y electrode 102 via the transistors CU1, 121, and 104. The potential of the Y electrode 102 is clamped to the positive potential Vs. Around the time t12, the sustain discharge starts between the X electrode 101 and the Y electrode 102.

Next, at a time t13, the transistor CU2 is turned on. The positive potential Vs is supplied to the Y electrode 102 via the transistors CU1, CU2, 121, and 104. To the Y electrode 102, a larger electric power is supplied and the sustain discharge is maintained. More specifically, a sustain discharge time is broadened. Later, the transistor Lu is turned off, and the transistors CU1 and CU2 are turned off.

As described above, by differentiating turn-on times of the transistors CU1 and CU2, the electric power supply to the Y electrode 102 can be dispersed temporally. Hereby, the streaking is reduced, so that the brightness of the pixels can be uniformized. Hereinafter, this clamp method is referred to as an electric power dispersion clamp.

Next, a case in which the sustain discharge is performed at a fall of the voltage of the Y electrode 102 will be described. By making the potential of the Y electrode 102 equal to the ground potential and the voltage of the X electrode 101 equal to the voltage Vs, the sustain discharge can be performed.

At a time t14, the transistor LD is turned on. The electric charge of the Y electrode 102 is emitted to the capacitance 119 connected to the ground by the L-C resonance via the transistors 103 and LD. The potential of the Y electrode 102 descends toward the ground potential.

Next, at a time tl5, the transistor CD1 is turned on. The Y electrode 102 is connected to the ground via the transistors 103 and CD1. The potential of the Y electrode 102 is clamped to the ground potential. Around the time t15, the sustain discharge starts.

Next, at a time t16, the transistor CD2 is turned on. The Y electrode 102 is connected to the ground via the transistors 103, CD1, and CD2. To the Y electrode 102 a larger electric power is supplied and the sustain discharge is maintained. Later, the transistor LU is turned off, and the transistors CU1 and CU2 are turned off.

As described above, by differentiating the turn-on times of the transistors CD1 and CD2, the electric power supply to the Y electrode 102 can be dispersed temporally. Also in the sustain discharge at the time of the fall, the streaking is reduced, so that the brightness of the pixels can be uniformized.

Thereafter, voltage waveforms of the electric power concentration clamps by controls at the times t1 to t4 in FIG. 2 are generated. In this manner, the voltage waveforms of the electric power dispersion clamp at the times t11 to t16 and the voltage waveforms of the electric power concentration clamp at the times t1 to t4 are alternately repeated.

Though the electric power dispersion clamp has a merit of reducing the streaking, a sufficient electric power may not be obtained at a discharge starting time since the electric power is dispersed, and the discharge may become unstable. In such a case, by generating a voltage pulse by the electric power dispersion clamp and a voltage pulse by the electric power concentration clamp in an alternately repeated manner as described above, the streaking can be reduced and the discharge can be stabilized.

The sustain discharges can be performed at both the times of the rise and the fall of the voltage of the Y electrode 102, or can be performed at either time of the rise or the fall. If the sustain discharge is performed only at the rise time, the electric power dispersion clamp is performed at the rise time in the times t11 to t13 and the electric power concentration clamp is performed at the fall time in the times t14 to t16. If the sustain discharge is performed only at the fall time, the electric power concentration clamp is performed at the rise time in the times t11 to t13 and the electric power dispersion clamp is performed at the fall time in the times t14 to t16. Details will be described later with reference to FIG. 12A to FIG. 12C.

Figure 4A:
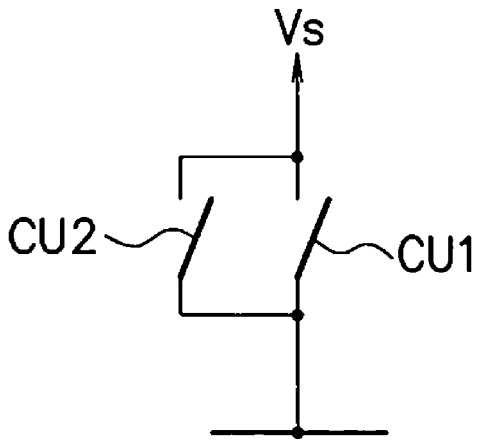
FIG. 4A and FIG. 4B are diagrams explaining an electric power dispersion clamp.
Figure 4B:
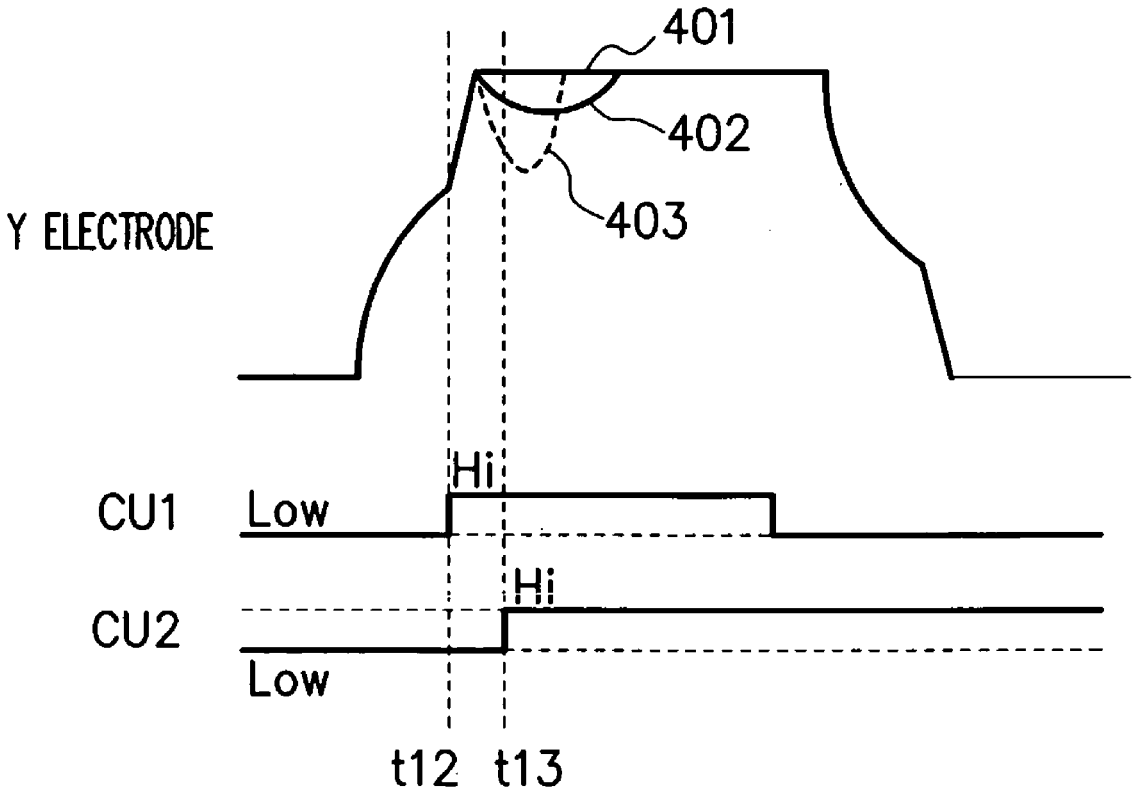

FIG. 4A and FIG. 4B are diagrams explaining the above-described electric power dispersion clamp in more detail. As shown in FIG. 4A, the transistors CU1 and CU2 function as switches. The switches CU1 and CU2 are parallelly connected. As shown in FIG. 4B, the switch CU1 is turned on at the time t12, and the switch CU2 is turned on at the later time t13. When a display cell is not addressed, the sustain discharge does not occur between the X electrode and the Y electrode, the voltage of the Y electrode 102 showing a voltage waveform 401, and a voltage drop does not occur. In contrast, when the display cell is addressed, the sustain discharge occurs between the X electrode and the Y electrode, the voltage of the Y electrode 102 showing a voltage waveform 402, and the voltage drop occurs.

In the electric power concentration clamp, the switches CU1 and CU2 are turned on simultaneously at the time t12. Then, a large electric power is supplied concentratively to the Y electrode 102, the voltage of the Y electrode 102 showing a voltage waveform 403, and a large voltage drop occurs in a short period. More specifically, the sustain discharge is performed in the short period.

In contrast, in the electric power dispersion clamp, since the switches CU1 and CU2 are turned on at different times, the electric power is supplied dispersedly to the Y electrode 102, the voltage of the Y electrode 102 showing the voltage waveform 402, and a small voltage drop occurs in a long period. More specifically, the sustain discharge is performed in the long period.

Incidentally, though an example in which two switches CU1 and CU2 are parallelly connected is described, three or more switches can be parallelly connected and turned on at different times.

Second Embodiment

Figure 5A:
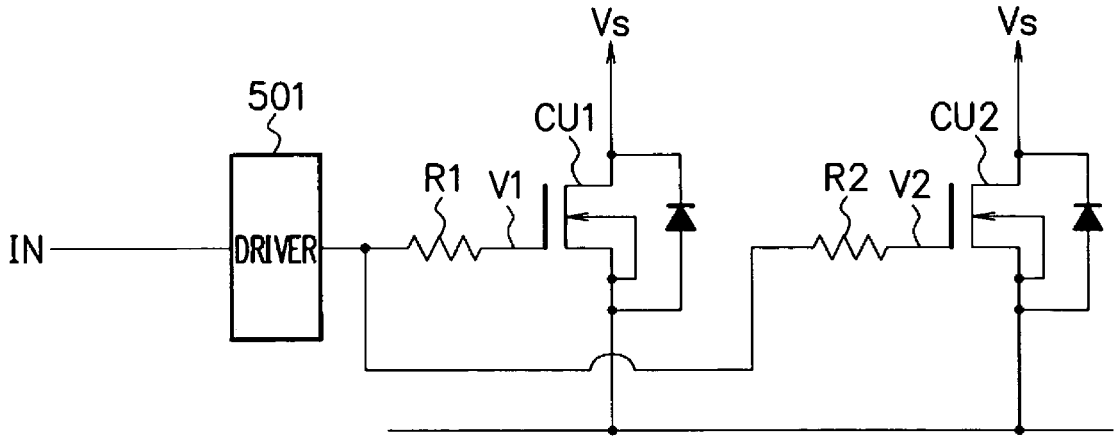
FIG. 5A is a circuit diagram showing a structural example of transistors CU1 and CU2 according to a second embodiment of the present invention.
Figure 5B:
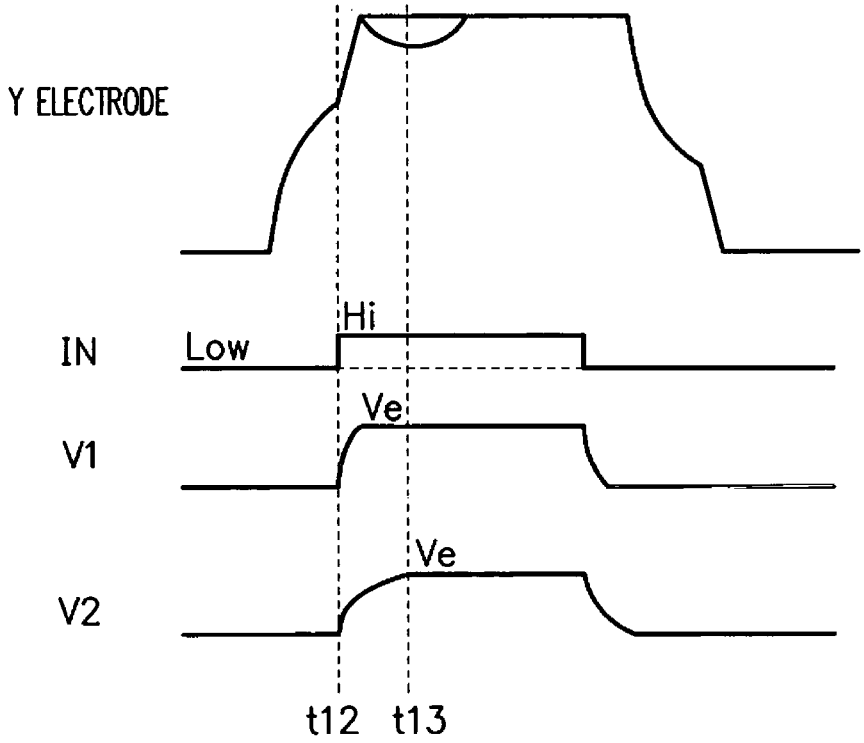
FIG. 5B is a timing chart explaining an operation thereof.

FIG. 5A is a circuit diagram showing a structural example of transistors CU1 and CU2 according to a second embodiment of the present invention, and FIG. 5B is a timing chart explaining an operation thereof. A gate of the transistor CU1 is provided with a gate resistance R1, while a gate of the transistor CU2 is provided with a gate resistance R2. An input signal IN is supplied to the gates of the transistors CU1 and CU2 via a driver 501. Here, the resistance R1 is smaller than the resistance 2.

At a time t12, the input signal IN is changed from a low level to a high level. Between the gates and sources of the transistors CU1 and CU2, there exist capacitances C respectively. Since the resistance R1 is small, a CR time constant is small and a rise time of a gate voltage V1 of the transistor CU1 is quick. In contrast, since the resistance R2 is large, a CR time constant is large and a rise time of a gate voltage V2 of the transistor CU2 is slow. After the gate voltage of the transistor CU1 reaches Ve, at a time t13 the gate voltage V2 of the transistor CU2 reaches Ve.

As described above, by differentiating values of the gate resistances R1 and R2 of the transistors CU1 and CU2 from each other, turn-on times of the transistors CU1 and CU2 are differentiated and the electric power dispersion clamp can be performed, as in the first embodiment.

Third Embodiment

Figure 6A:
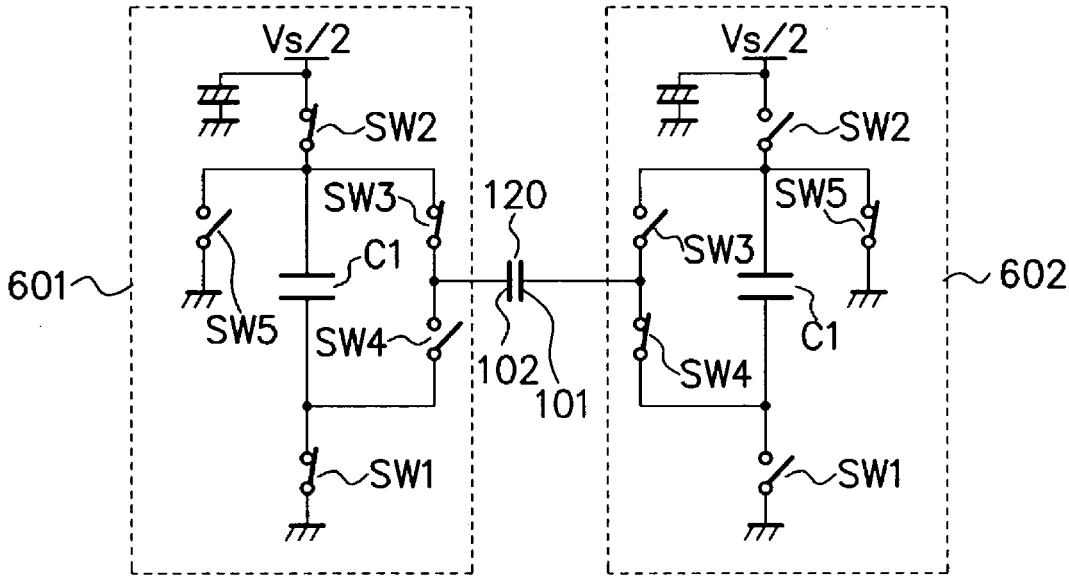
FIG. 6A is a circuit diagram showing a structural example of a Y electrode sustain circuit according to a TERES (Technology of Reciprocal Sustainer)
Figure 6B:
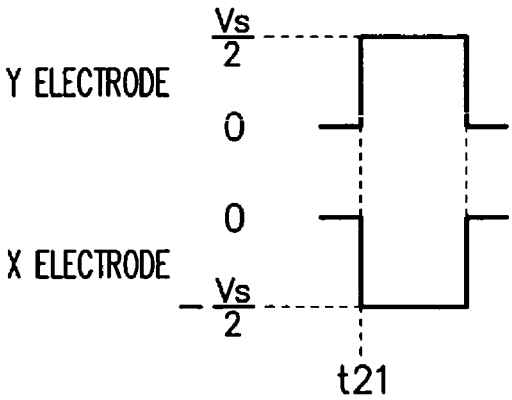
FIG. 6B and FIG. 6C are charts showing voltage waveforms of a Y electrode and an X electrode.
Figure 6C:
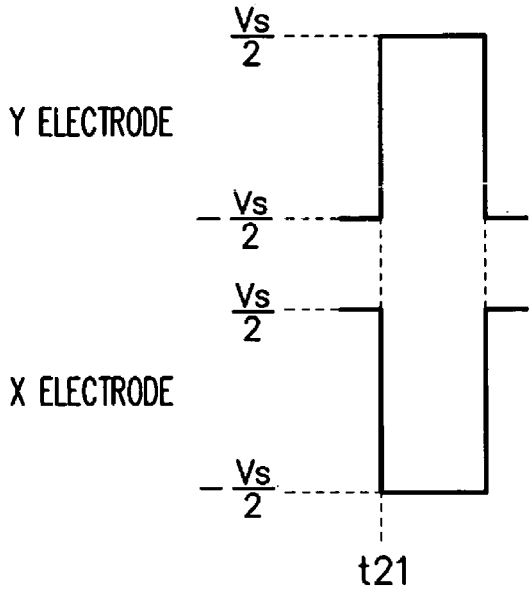

FIG. 6A is a circuit diagram showing a structural example of a Y electrode sustain circuit according to a TERES (Technology of Reciprocal Sustainer), and FIG. 6B and FIG. 6C are diagrams showing voltage waveforms of the Y electrode and an X electrode. This TERES circuit can generate a voltage pulse similar to the Y electrode sustain circuit in FIG. 1. Incidentally, in the TERES circuit in FIG. 6A, a power recovery circuit for performing an L-C resonance is omitted and only a clamp circuit is shown.

The Y electrode sustain circuit 601 and an X electrode sustain circuit 602 have the same structures. First, an operation of the Y electrode sustain circuit 601 will be described. At a time t21, switches SW1, SW2, and SW3 are turned on, and switches SW4 and SW5 are turned off. A positive potential Vs/2 is supplied to a Y electrode 102 via the switches SW2 and SW3. To a capacitance C1, an electric charge of the voltage Vs/2 is charged, and the voltage Vs/2 of the capacitance C1 is supplied to the Y electrode 102 via the switch SW3. Consequently, a voltage of the Y electrode 102 becomes Vs/2.

Next, an operation of the X electrode sustain circuit 602 will be described. At a time t21, switches SW1, SW2, and SW3 are turned off, and switches SW4 and SW5 are turned on. With regard to a capacitance C1, an electric charge of a voltage Vs/2 is always charged to an upper electrode with reference to a lower electrode. When the switch SW5 is turned on, a voltage −Vs/2 of the lower end of the capacitance C1 is supplied to the X electrode 101 via the switch SW4. Consequently, a voltage of the X electrode 101 becomes −Vs/2.

At a time t21, a potential difference between the X electrode 101 and the Y electrode 102 is Vs. Therefore, around the time t21 a sustain discharge occurs.

Figure 7A:
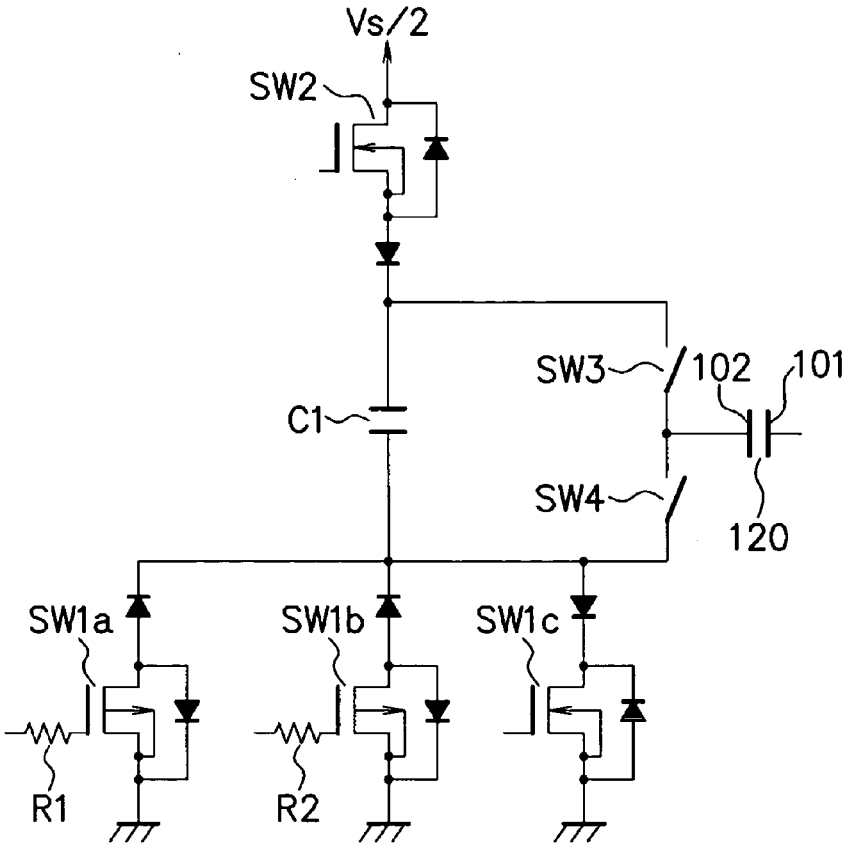
FIG. 7A is a circuit diagram showing a structural example of one part of a TERES circuit according to a third embodiment of the present invention.

FIG. 7A is a circuit diagram showing a structural example of a part of a TERES circuit according to a third embodiment of the present invention. In the present invention, two parallel switches SW1*a* and SW1*b* as well as one switch SW1*c* substitute the one switch SW1 in FIG. 6A. The switches SW1*a* and SW1*b* are constituted with p-channel transistors having parasitic diodes. The switch SW1*c* is constituted with an n-channel transistor having a parasitic diode. With regard to the transistors SW1*a*, SW1*b*, and SW1*c*, sources are connected to ground, and the drains are connected to the lower electrode of the capacitance C1 via diodes. With regard to the capacitance C1, the upper electrode is connected to the Y electrode 102 via a switch SW3, and the lower electrode is connected to the Y electrode 102 via a switch SW4. A switch SW2 is constituted with an n-channel transistor having a parasitic diode. With regard to the transistor SW2, a drain is connected to a positive potential Vs/2 while a source is connected to the upper electrode of the capacitance C1 via a diode.

Also in the present embodiment, as in the first and second embodiments, by turning on the switches SW1*a* and SW1*b* at different times, an electric power dispersion clamp can be performed.

Figure 7B:
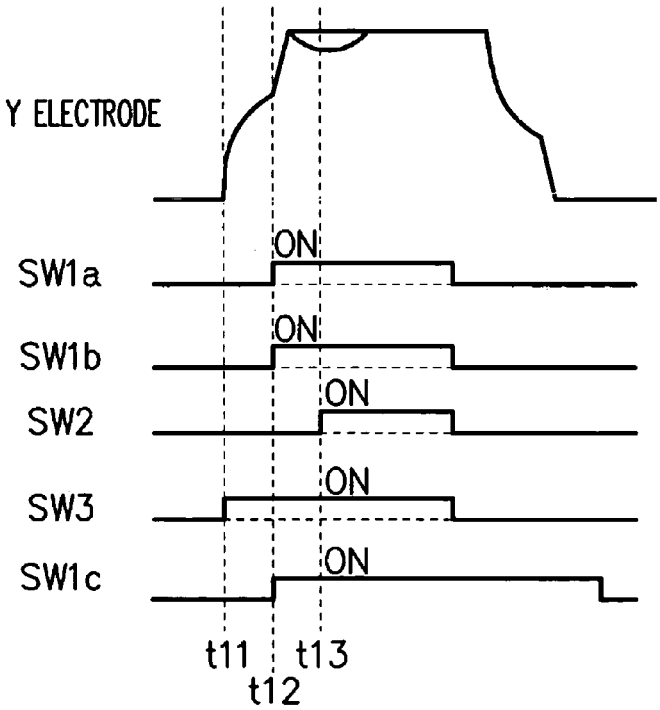
FIG. 7B is a timing chart showing the electric power dispersion clamp.

FIG. 7B is a timing chart showing another electric power dispersion clamp method. First, at a time t11, the switch SW3 is turned on, and the voltage of the Y electrode 102 ascends toward Vs/2 by an L-C resonance of a power recovery circuit.

Next, at a time t12, the switches SW1*a*, SW1*b*, and SW1*c* are turned on simultaneously. At this time, the switch SW2 is in an off state. As described above, with regard to the capacitance C1, an electric charge of the voltage Vs/2 is always charged to the upper electrode with reference to the lower electrode. Therefore, the voltage Vs/2 of the upper electrode of the capacitance C1 is supplied to the Y electrode 102 via the switch SW3. The voltage of the Y electrode 102 ascends to Vs/2. Around the time t12, the sustain discharge starts.

Next, at a time t13, the switch SW2 is turned on. The positive potential Vs/2 is supplied to the Y electrode 102 via the switches SW2 and SW3. After the time t12, as described above, the voltage Vs/2 of the upper electrode of the capacitance C1 is supplied to the Y electrode 102 via the switch SW3. To the Y electrode 102, a large electric power is supplied from the above-described two routes and the sustain discharge is maintained.

As described above, by differentiating a turn-on time of the switches SW1*a* and SW1*b* from a turn-on time of the switch SW2, the electric power dispersion clamp can be performed.

Fourth Embodiment

Figure 17:
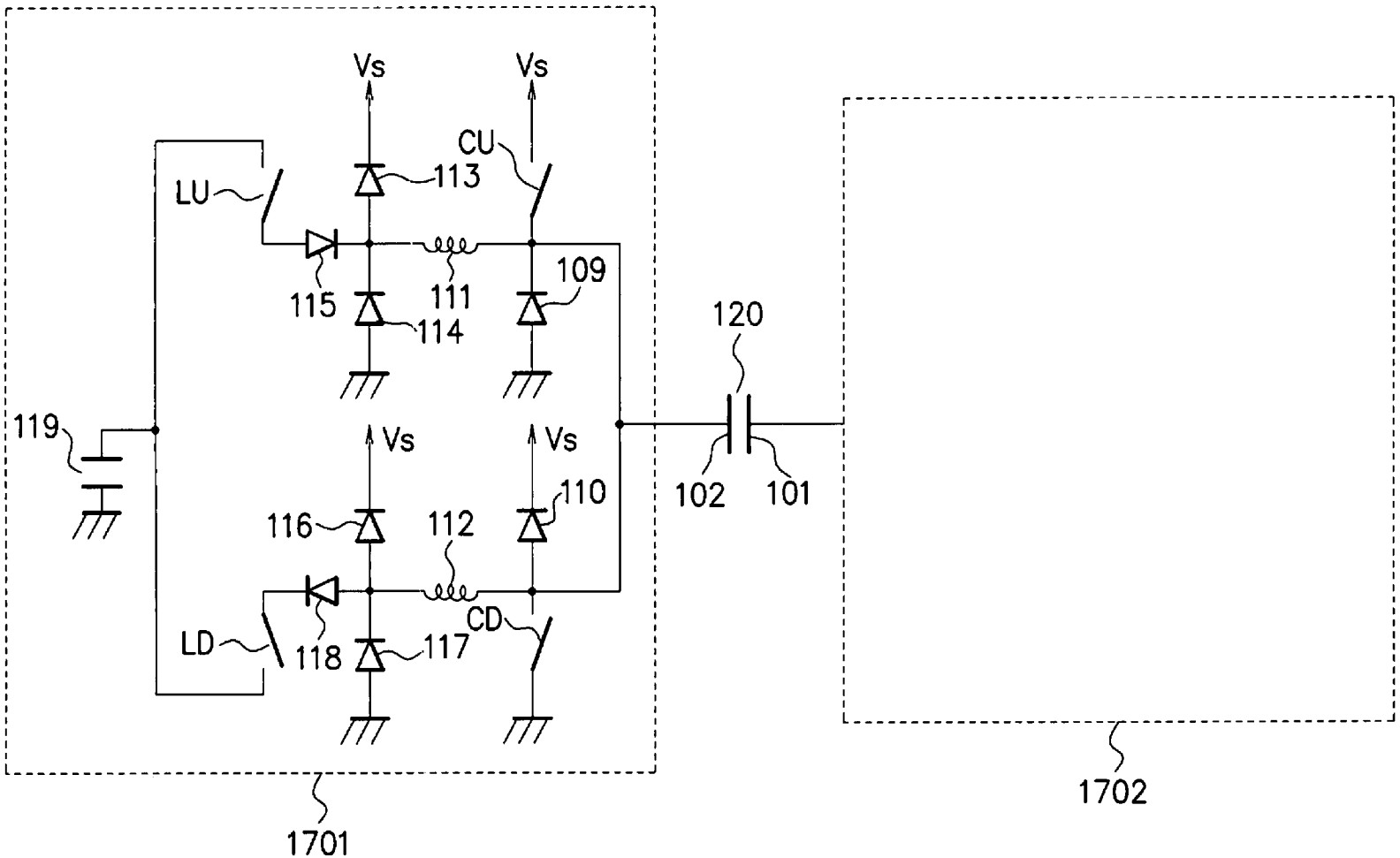
FIG. 17 is a circuit diagram showing a structural example of a Y electrode sustain circuit and an X electrode sustain circuit.

FIG. 17 is a circuit diagram showing a structural example of a Y electrode sustain circuit 1701 and an X electrode sustain circuit 1702. Structures of the sustain circuits 1701 and 1702 are the same. A switch CU is provided instead of the parallel switches CU1 and CU2 in FIG. 1, and a switch CD is provided instead of the parallel switches CD1 and CD2 in FIG. 1. The others are the same as in FIG. 1.

Figure 8:
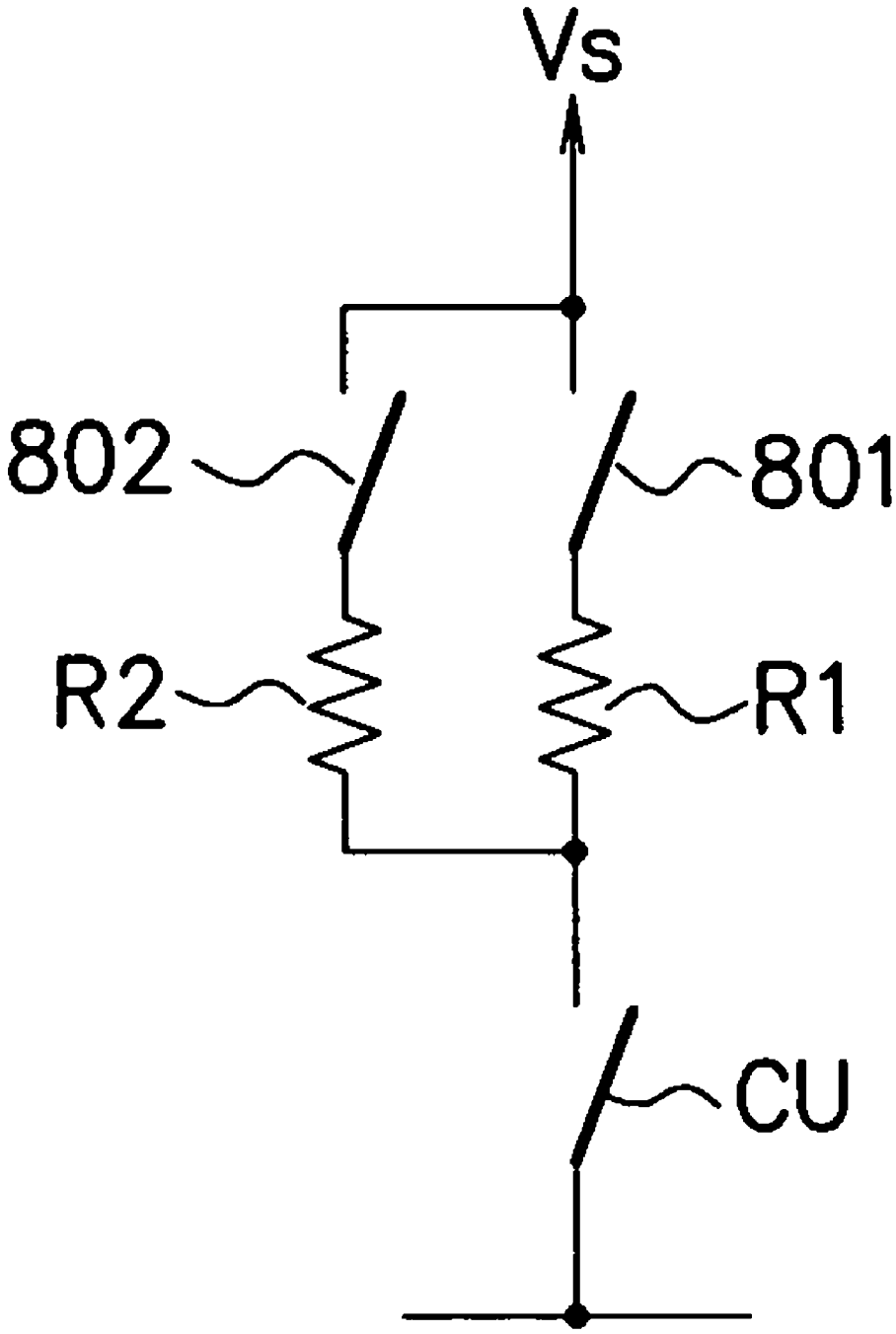
FIG. 8 is a circuit diagram showing a structural example of limiting resistances R1 and R2 of a switch CU according to a fourth embodiment of the present invention.

FIG. 8 is a circuit diagram showing a structural example of limiting resistances R1 and R2 of a switch CU according to a fourth embodiment of the present invention. A serial connection of the limiting resistance R1 and a switch 801 as well as a serial connection of the limiting resistance R2 and a switch 802 are connected parallelly. The parallel connection is connected serially to the switch CU. Incidentally, the parallel connection can be connected serially to the switch CU above (first side) or below (second side) the switch CU. The resistances R1 and R2 can be connected serially to the switches 801 and 802 respectively below (second side) or above (first side) the switches 801 and 802.

With regard to a streaking, brightness of pixels varies depending on a display ratio. Here, the display ratio indicates a proportion of the number of display (lighting) pixels relative to the whole number of pixels per sub frame SF in FIG. 20. When the display ratio is small, the streaking has little influence and a normal electric power concentration clamp is selected. In contrast, when the display ratio is large, the streaking has significant influence and an electric power dispersion clamp is selected.

Here, the resistance R1 is larger than the resistance R2. The resistance R2 can be 0 "zero" [Ω]. When the display ratio is small, the switch 801 is turned off and the switch 802 is turned on. The resistance R2 is serially connected to the switch CU. Since the resistance R2 is small, a CR time constant is small and the electric power of the voltage Vs can be supplied to the Y electrode 102 by a quick rise, so that the electric power concentration clamp can be performed. When the display ratio is small, the electric power concentration clamp can be adopted since the streaking has little influence.

In contrast, when the display ratio is large, the switch 801 is turned on and the switch 802 is turned off. The resistance R1 is serially connected to the switch CU. Since the resistance R1 is large, a CR time constant is large and the electric power of the voltage Vs can be supplied to the Y electrode 102 by a slow rise, so that the electric power dispersion clamp can be performed. When the display ratio is large, the streaking has significant influence, and by performing the electric power dispersion clamp, the streaking can be reduced.

Fifth Embodiment

Figure 9:
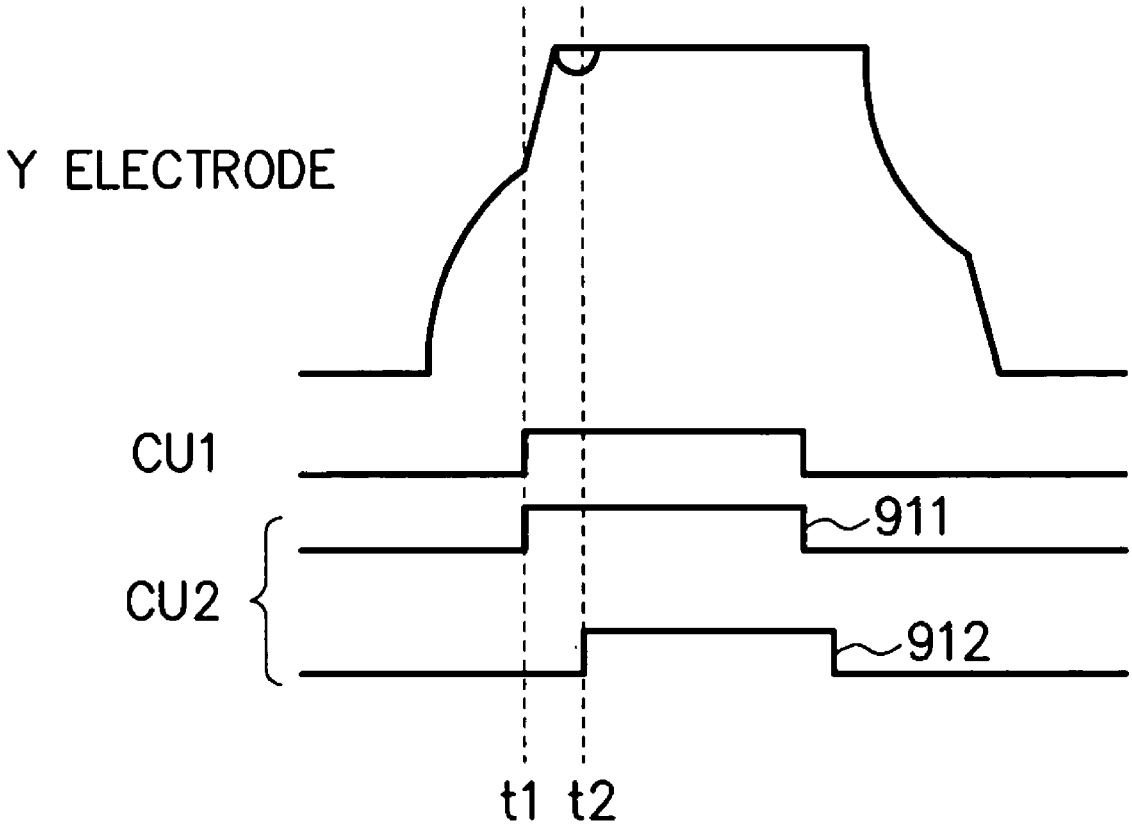
FIG. 9 is a timing chart showing a control method of switches CU1 and CU2 according to a fifth embodiment of the present invention.

FIG. 9 is a timing chart showing a control method of switches CU1 and CU2 according to a fifth embodiment of the present invention. The present embodiment has the circuit structure in FIG. 1. A switch CU2 changes over a control signal 911 at a time of a small display ratio and a control signal 912 at a time of a large display ratio.

First, a control method at the time of the small display ratio will be described. As described above, when the display ratio is small, the streaking has little influence and the switches CUT and CU2 (control signal 911) are turned on simultaneously at a time 1. This control method is the same as the control in FIG. 2 and realizes an electric power concentration clamp.

Next, a control method at the time of the large display rate will be described. As described above, when the display ratio is large, the streaking has significant influence, and at the time t1 the switch CU1 is turned on, and later at a different time t2 the switch CU2 (control signal 912) is turned on. This control method is the same as the control in FIG. 3, and realizes an electric power dispersion clamp. When the display ratio is large, the streaking has significant influence and by performing the electric power dispersion clamp, the streaking can be reduced.

Sixth Embodiment

Figure 10A:
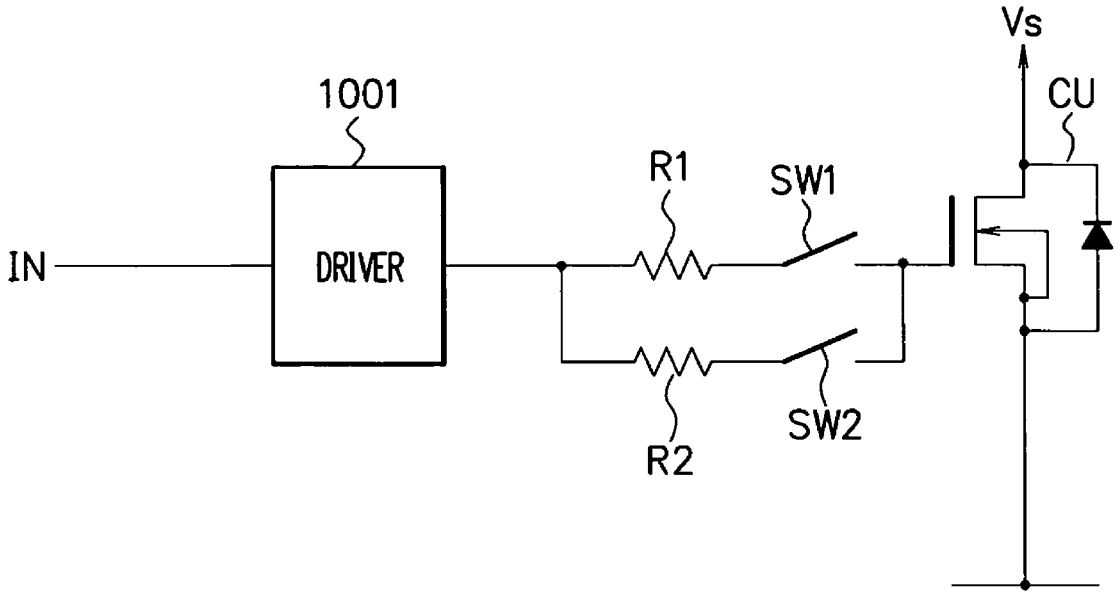
FIG. 10A and FIG. 10B are circuit diagrams showing structural examples of gate resistances R1 and R2 of transistors CU according to a sixth embodiment of the present invention.

FIG. 10A is a circuit diagram showing a structural example of gate resistances R1 and R2 of a transistor CU according to a sixth embodiment of the present invention. The entire structure of the present embodiment has the structure in FIG. 17. A serial connection of the gate resistance R1 and a switch SW1 as well as a serial connection of the gate resistance R2 and switch SW2 are connected parallelly. The parallel connection is connected between a gate of the transistor CU and a driver 1001. An input signal IN is supplied to the gate of the transistor CU via the driver 1001. In the present embodiment, a gate resistance value of the transistor CU is changed in accordance with the display ratio. The gate resistance R1 is larger than the gate resistance R2. Incidentally, the resistances R1 and R2, respectively, can be provided at a left side (first side) or at a right side (second side) of the switches SW1 and SW2.

When the display ratio is small, the streaking has little influence, so the switch SW1 is turned off and the switch SW2 is turned on. The resistance R2 is connected to the gate of the transistor CU. Since the resistance R2 is small, as shown by the gate voltage V1 in FIG. 5B, a rising speed is fast and an electric power concentration clamp can be realized.

When the display ratio is large, the streaking has significant influence, so the switch SW1 is turned on and the switch SW2 is turned off. The resistance R1 is connected to the gate of the transistor CU. Since the resistance R1 is large, as shown by the gate voltage V2 in FIG. 5B, the rising speed is slow, so that an electric power dispersion clamp can be realized and the streaking can be reduced.

Figure 10B:
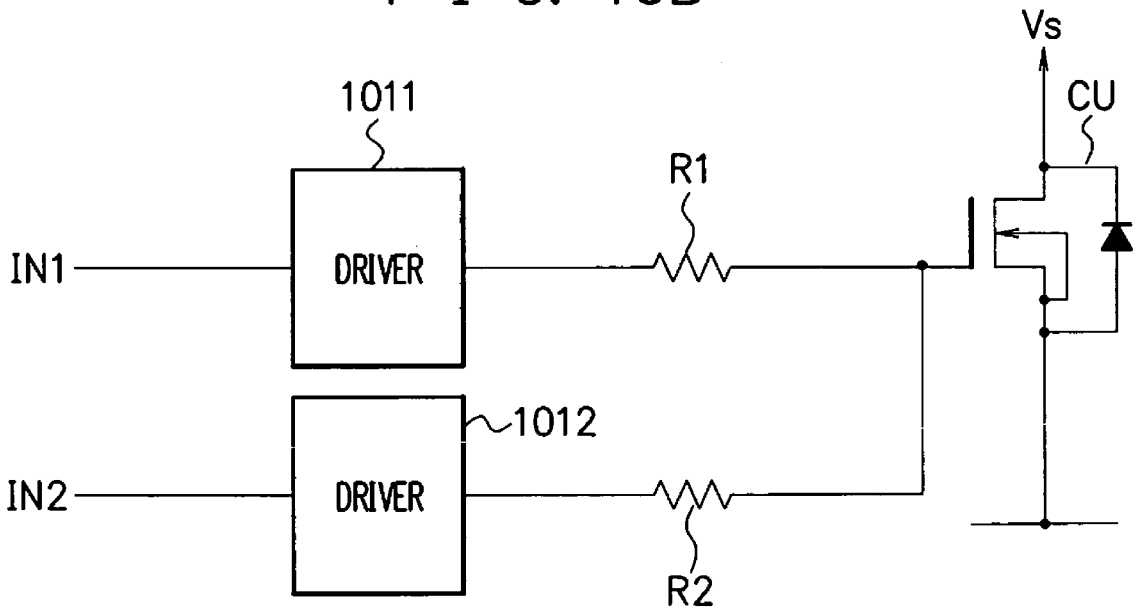

FIG. 10B is a circuit diagram showing a structural example of gate resistances R1 and R2 of another transistor CU. An input signal IN1 is supplied to a gate of the transistor CU via a driver 1011 and the gate resistance R1. An input signal IN2 is supplied to the gate of the transistor CU via a driver 1012 and the gate resistance R2. The resistance R1 is larger than the resistance R2.

When the display ratio is small, the input signal IN1 is turned off with being low level, and the transistor CU is controlled by the input signal IN2. By using the small gate resistance R2, the electric power concentration clamp can be realized.

When the display ratio is large, the transistor CU is controlled by the input signal IN1, and the input signal IN2 is turned off with being low level. By using a large gate resistance R1, the electric power dispersion clamp can be realized and the streaking can be reduced.

Seventh Embodiment

An entire structure of a seventh embodiment of the present invention has the structure in FIG. 17.

Figure 11A:
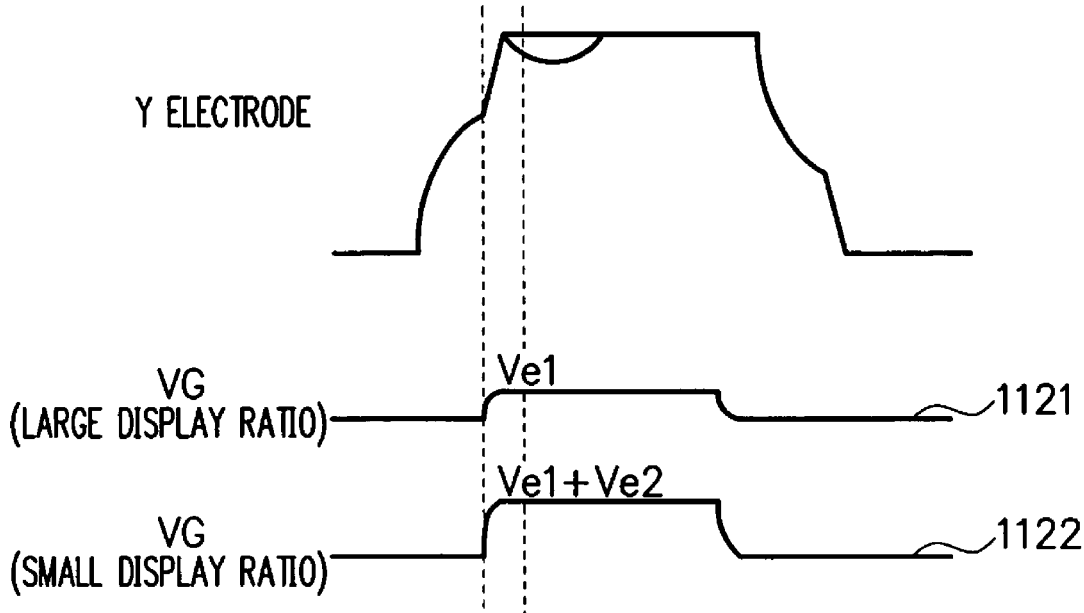
FIG. 11A and FIG. 11B are timing charts showing control methods of gate voltages of a transistor CU according to a seventh embodiment of the present invention.

FIG. 11A is a timing chart showing a control method of a gate voltage VG of a switch (transistor) CU according to a seventh embodiment of the present invention. In the present embodiment, the gate voltage VG is changed in accordance with a display ratio. With regard to the gate voltage VG, a waveform 1121 is a waveform at a time of a large display ratio, while a waveform 1122 is a waveform at a time of a small display ratio.

First, a case of the small display ratio will be described. At a time t12, the gate voltage VG of the transistor CU is a high voltage Ve1+Ve2, as shown by the waveform 1122. When the gate voltage VG becomes the high voltage Ve1+Ve2, a resistance between a source and a drain of the transistor CU becomes small, and similarly to the above description for FIG. 8, an electric power of the voltage Vs can be supplied to the Y electrode 102 by a quick rise, so that the electric power concentration clamp can be performed.

Next, a case of the large display ratio will be described. At the time t12, the gate voltage VG of the transistor CU becomes a low voltage Ve1 as shown by the waveform 1121. When the gate voltage VG becomes the low voltage Ve1, the resistance between the source and drain of the transistor CU becomes large, and similarly to the above description for FIG. 8, the electric power of the voltage Vs can be supplied to the Y electrode 102 by a slow rise, so that the electric power dispersion clamp can be performed and the streaking can be reduced.

Figure 11B:
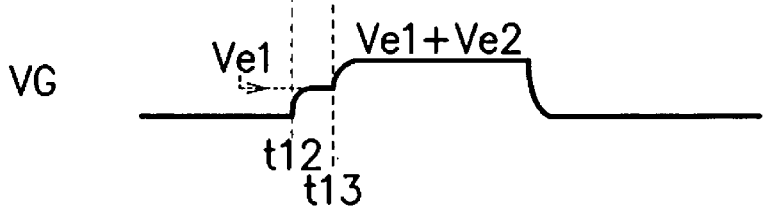

FIG. 11B is a timing chart showing a control method of another gate voltage VG, and shows an electric power dispersion clamp method. At a time t12, the gate voltage VG of the transistor CU becomes a low voltage Ve1, and a comparatively small electric power is supplied to the Y electrode 102. Next, at a time t13, the gate voltage VG of the transistor CU becomes a high voltage Ve1+Ve2, and a comparatively large electric power is supplied to the Y electrode 102. As described above, by changing (raising) the gate voltage VG stepwise in two or more steps, the electric power dispersion clamp can be realized and the streaking can be reduced.

Eighth Embodiment

Figure 12A:
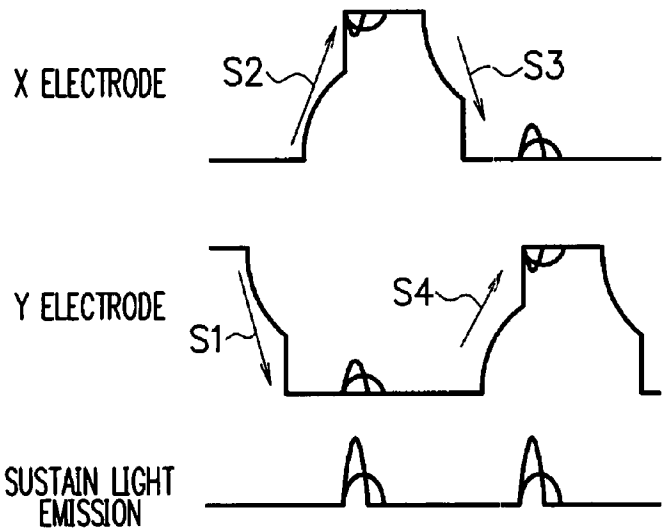
FIG. 12A to FIG. 12C are waveform diagrams showing sustain pulses of an X electrode and a Y electrode according to an eighth embodiment of the present invention.
Figure 12B:
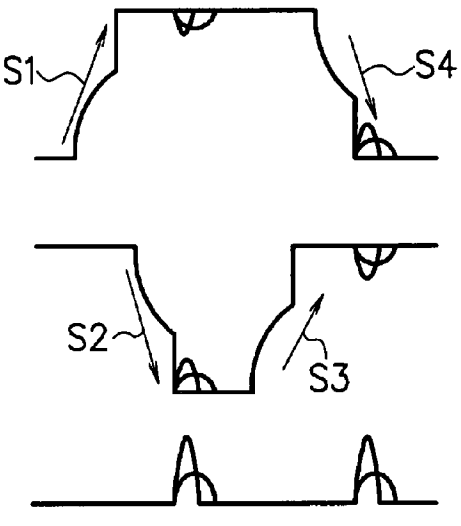
Figure 12C:
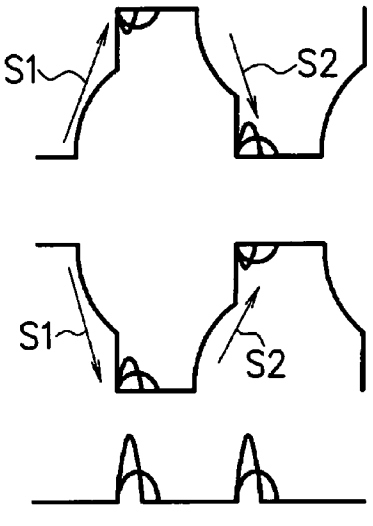

FIG. 12A to FIG. 12C are waveform diagrams showing sustain pulses of an X electrode 101 and a Y electrode 102 according to an eighth embodiment of the present invention.

FIG. 12A shows an example in which a sustain light emission (discharge) is performed at a time of a rise. First, at a step S1, a voltage of the Y electrode 102 is made fall by an electric power concentration clamp. Next, at a step S2, a voltage of the X electrode 101 is made rise by the electric power dispersion clamp. Hereby, a potential difference Vs occurs between the X electrode 101 and the Y electrode 102, and the sustain light emission is performed. Next, at a step S3, the voltage of the X electrode 101 is made fall by the electric power concentration clamp. Next, at a step S4, the voltage of the Y electrode 102 is made rise by the electric power dispersion clamp. Hereby, a potential difference Vs occurs between the X electrode 101 and the Y electrode 102, and the sustain light emission is performed.

FIG. 12B shows an example in which the sustain light emission is performed at a time of a fall. First, at a step S1, the voltage of the X electrode 101 is made rise by the electric power concentration clamp. Next, at a step S2, the voltage of the Y electrode 102 is made fall by the electric power dispersion clamp. Hereby, a potential difference Vs occurs between the X electrode 101 and the Y electrode 102, and the sustain light emission is performed. Next, at a step S3, the voltage of the Y electrode 102 is made rise by the electric power concentration clamp. Next, at a step S4, the voltage of the X electrode 101 is made fall by the electric power dispersion clamp. Hereby, a potential difference Vs occurs between the X electrode 101 and the Y electrode 102, and the sustain light emission is performed.

FIG. 12C shows an example in which the sustain light emission is performed by combining a rise pulse and a fall pulse. First, at a step S1, the voltage of the X electrode 101 is made rise by the electric power dispersion clamp, while the voltage of the Y electrode 102 is made fall by the electric power dispersion clamp. Hereby, a potential difference Vs occurs between the X electrode 101 and the Y electrode 102, and the sustain light emission is performed. Next, at a step S2, the voltage of the X electrode 101 is made fall by the electric power dispersion clamp, while the voltage of the Y electrode 102 is made rise by the electric power dispersion clamp. Hereby, the potential difference Vs occurs between the X electrode 101 and the Y electrode 102, and the sustain light emission is performed. Incidentally, the method is not limited to the method in which the electric power dispersion clamps are performed at both times of the rise and the fall, and it is possible that the electric power dispersion clamp is performed only at the rise time or the electric power dispersion clamp is performed only at the fall time.

Ninth Embodiment

FIG. 13A to FIG. 13D are waveform diagrams showing sustain pulses of an X electrode 101 and a Y electrode 102 according to a ninth embodiment of the present invention. A symbol ○ denotes an electric power dispersion clamp, while a symbol Δ denotes an electric power concentration clamp.

Figure 13A:
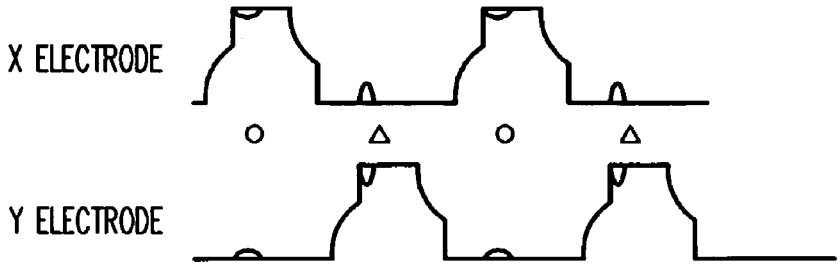
FIG. 13A to FIG. 13D are waveform diagrams showing sustain pulses of an X electrode and a Y electrode according to a ninth embodiment of the present invention.

In FIG. 13A, a voltage of the X electrode 101 is made rise by the electric power dispersion clamp, and a sustain light emission is performed. Next, a voltage of the Y electrode 102 is made rise by the electric power concentration clamp, and the sustain light emission is performed. Next, the voltage of the X electrode 101 is made rise by the electric power dispersion clamp, and the sustain light emission is performed. Next, the voltage of the Y electrode 102 is made rise by the electric power concentration clamp, and the sustain light emission is performed. As described above, the sustain light emission by one electric power dispersion clamp and the sustain light emission by one electric power concentration clamp are alternately repeated. Hereby, as in the first embodiment in FIG. 3, it is possible to reduce a streaking and to stabilize a discharge. By repeating n-times of the electric power dispersion clamps and n-times of the electric power concentration clamps, there can be obtained a characteristic having both the reduced streaking and the stable discharge. Here, n is an integer of one or more.

Figure 13B:
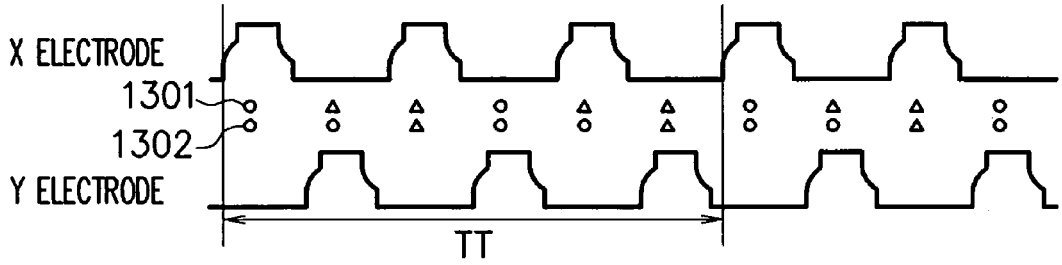

FIG. 13B shows a first sustain method 1301 and a second sustain method 1302. The first sustain method 1301 will be described. First, the voltage of the X electrode 101 is made rise by the electric power dispersion clamp, and the sustain light emission is performed. Secondly, the voltage of the Y electrode 102 is made rise by the electric power concentration clamp, and the sustain light emission is performed. Thirdly, the voltage of the X electrode 101 is made rise by the electric power concentration clamp, and the sustain light emission is performed. Fourthly, the voltage of the Y electrode 102 is made rise by the electric power dispersion clamp, and the sustain light emission is performed. Fifthly, the voltage of the X electrode 101 is made rise by the electric power concentration clamp, and the sustain light emission is performed. Sixthly, the voltage of the Y electrode 102 is made rise by the electric power concentration clamp, and the sustain light emission is performed. The above processes TT are repeated as one cycle. As described above, in the first sustain method 1301, the sustain light emission by one electric power dispersion clamp and sustain light emissions by two electric power concentration clamps are repeated. By repeating n time(s) of the electric power dispersion clamp(s) and n+m times of the electric power concentration clamps, a characteristic in which discharge stability is emphasized can be obtained. Here, m is an integer of one or more.

In the second sustain method 1302, similarly, sustain light emissions by two electric power dispersion clamps and a sustain light emission by one electric power concentration clamp are repeated. By repeating the n+m times of the electric power dispersion clamps and n time(s) of the electric power concentration clamp(s), a characteristic in which a decrease in a streaking is emphasized can be obtained.

Figure 13C:
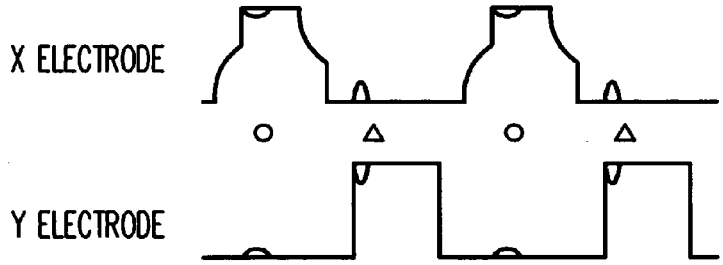

In FIG. 13C, the electric power concentration clamp pulse of the Y electrode in FIG. 13A is substituted by an electric power concentration clamp pulse of a clamp without an L-C resonance. The electric power concentration clamp pulse of the clamp only is, without the processes of the times t1 and t3 in FIG. 2, made rise at the time t2 and made fall at the time t4. Also in the case shown in FIG. 13B, similarly, the rise pulse of the electric power concentration clamp can be substituted by an electric power concentration clamp pulse without an L-C resonance.

Figure 13D:
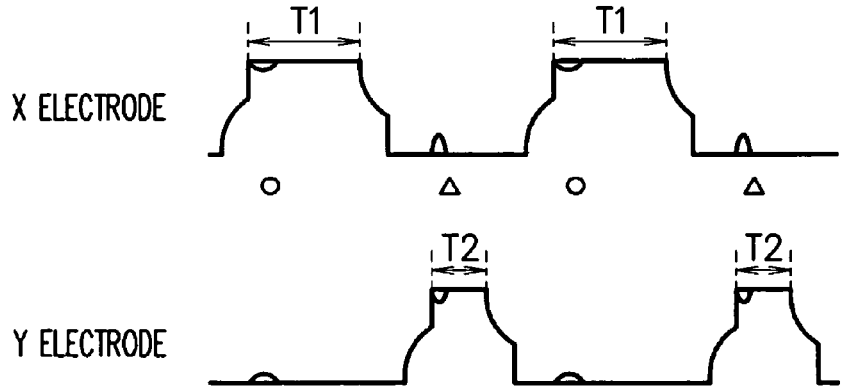

In FIG. 13D, a width T1 of the electric power dispersion clamp pulse of the X electrode 101 is made longer than a width T2 of the electric power concentration clamp pulse of the Y electrode 102 in the voltage waveforms in FIG. 13A. Also in FIG. 13B and FIG. 13C, similarly, widths T1 of the electric power dispersion clamp pulses can be made longer than widths T2 of the electric power concentration clamp pulses.

Tenth Embodiment

Figure 14:
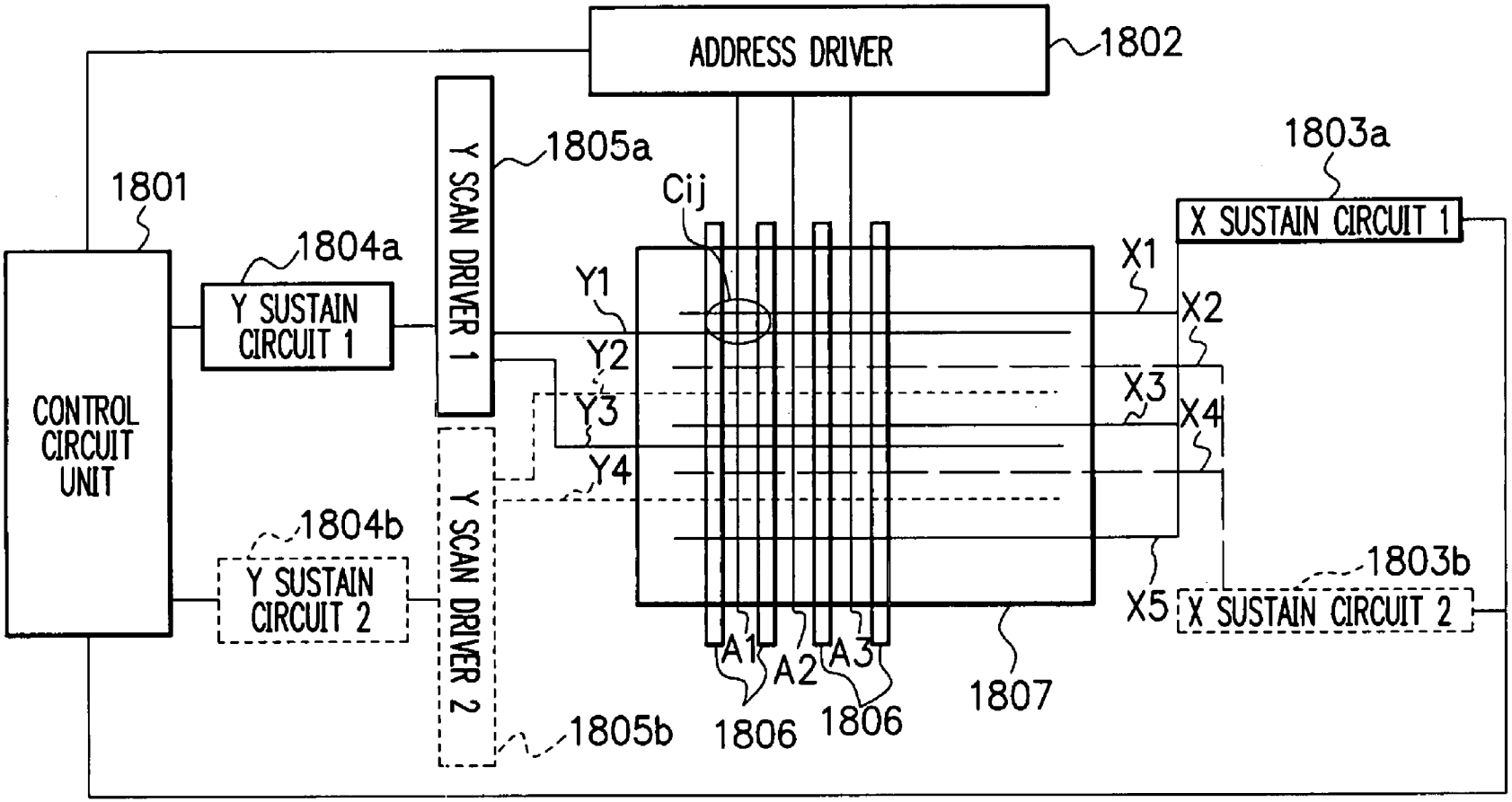
FIG. 14 is a diagram showing a basic structure of a plasma display panel device of an ALIS (Alternate Lighting of Surfaces) method.

FIG. 14 is a diagram showing a basic structure of a plasma display panel device of an ALIS (Alternate Lighting of Surfaces) method. Differences between the device in FIG. 14 and the device in FIG. 18 will be described. The Y electrode sustain circuits 1804*a* and 1804*b* are provided instead of the Y electrode sustain circuit 1804 in FIG. 18, scan drivers 1805*a* and 1805*b* are provided instead of the scan driver 1805 in FIG. 18, and X electrode sustain circuits 1803*a* and 1803*b* are provided instead of the X electrode sustain circuit 1803 in FIG. 18. The Y electrode sustain circuit 1804*a* and the scan driver 1805*a* supply voltages to odd-number-th Y electrodes Y1, Y3, . . . . The Y electrode sustain circuit 1804*b* and the scan driver 1805*b* supply voltages to even-number-th Y electrodes Y2, Y4, . . . . The X electrode sustain circuit 1803*a* supplies voltages to odd-number-th X electrodes X1, X3, . . . . The X electrode sustain circuit 1803*b* supplies voltages to even-number-th X electrodes X2, X4, . . . .

Figure 15:
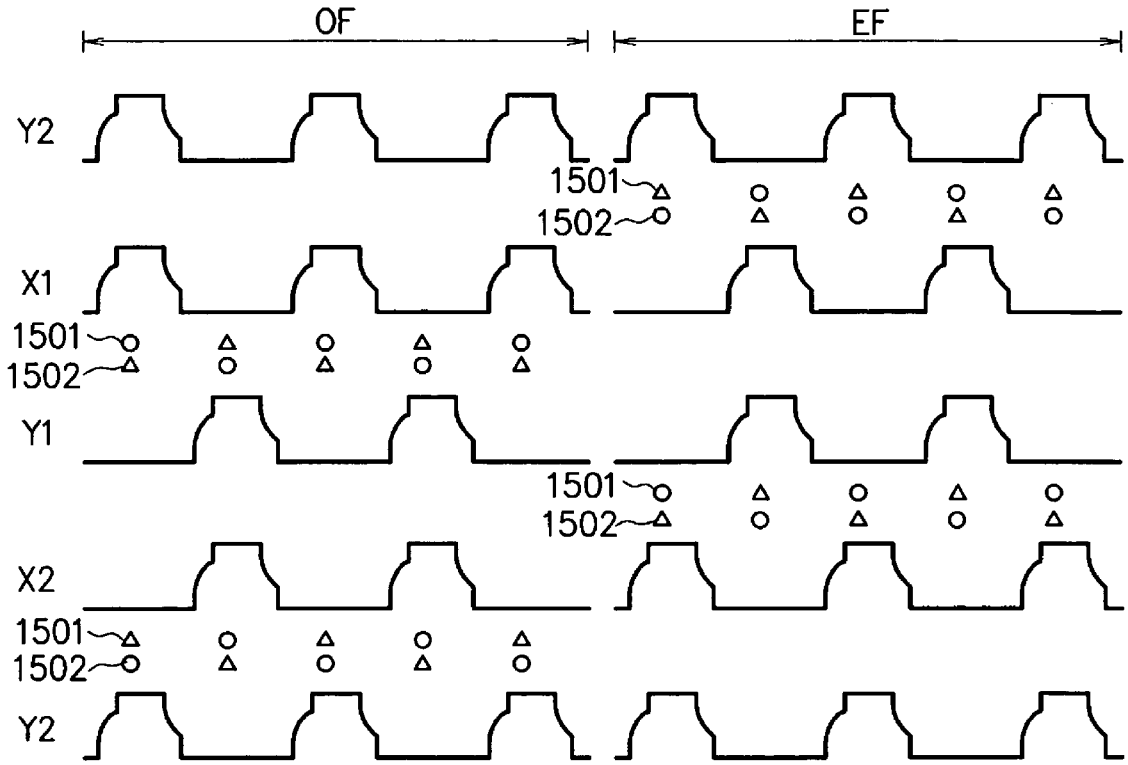
FIG. 15 is a waveform diagram showing sustain pulses of X electrodes X1 and X2 as well as Y electrodes Y1 and Y2 according to a tenth embodiment of the present invention.

FIG. 15 is a waveform diagram showing sustain pulses of the X electrodes X1 and X2 as well as the Y electrodes Y1 and Y2 according to a tenth embodiment of the present invention. The same voltages are applied to odd-number-th X electrodes, the same voltages are applied to even-number-th X electrodes, the same voltages are applied to odd-number-th Y electrodes, and the same voltages are applied to even-number-th Y electrodes. In FIG. 15, odd-number-th X electrodes are denoted by X1, even-number-th X electrodes are denoted by X2, odd-number-th Y electrodes are denoted by Y1, and even-number-th Y electrodes are denoted by Y2.

In the ALIS method, an odd field OF and an even field EF are alternately repeated. In the odd field OF, between the electrodes X1 and Y2 a sustain light emission is performed, and between the electrodes X2 and Y2 the sustain light emission is performed. In the even field EF, between the electrodes Y2 and X1 the sustain light emission is performed and between the electrodes Y1 and X2 the sustain light emission is performed. More specifically, the X electrode is capable of performing a sustain discharge for display, between Y electrodes of both adjacent sides, and the Y electrode is also capable of performing the sustain discharge for display, between X electrodes of both adjacent sides. In a first sustain method 1501 and a second sustain method 1502, a symbol ○ denotes an electric power dispersion clamp, while a symbol Δ denotes an electric power concentration clamp.

First, the first sustain method 1501 will be described. The sustain light emission by the electric power dispersion clamp and the sustain light emission by the electric power concentration clamp are performed alternately. In doing so, the electric power dispersion clamps are performed only at rise times of the X electrodes X1 and X2.

Next, the second sustain method 1502 will be described. The sustain light emission by the electric power concentration clamp and the sustain light emission by the electric power dispersion clamp are performed alternately. In doing so, the electric power dispersion clamps are performed only at rise times of the Y electrodes Y1 and Y2.

According to the present embodiment, by alternately repeating the electric power dispersion clamp and the electric power concentration clamp in the ALIS method, the discharge variation can be prevented.

Eleventh Embodiment

Figure 16:
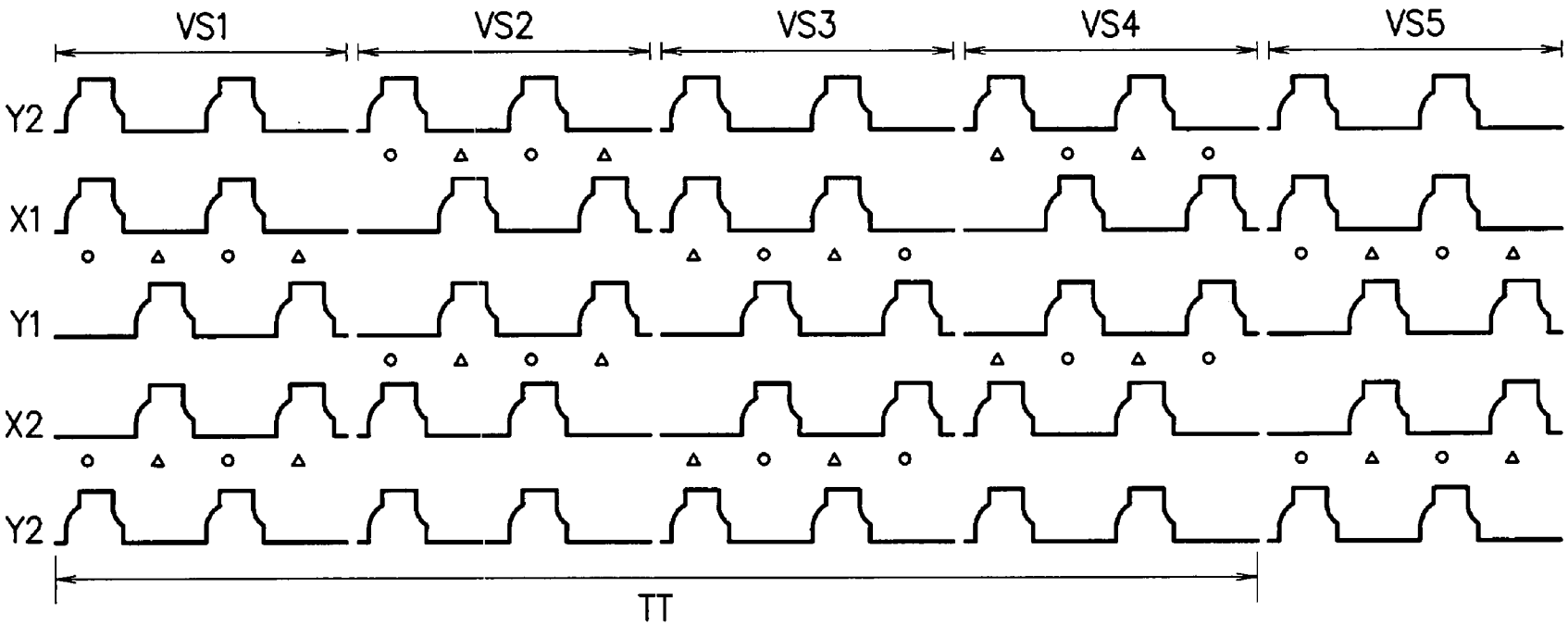
FIG. 16 is a waveform diagram showing sustain pulses of X electrodes X1 and X2 as well as Y electrode Y1 and Y2 of an ALIS method according to an eleventh embodiment of the present invention.

FIG. 16 is a waveform diagram showing sustain pulses of X electrodes X1 and X2 as well as Y electrodes Y1 and Y2 in an ALIS method according to an eleventh embodiment of the present invention. A first field VS1 is a filed by a first vertical synchronization signal, a second field VS2 is a field by a second vertical synchronization signal, a third field VS3 is a field by a third vertical synchronization signal, a fourth field VS4 is a field by a fourth vertical synchronization signal, and a fifth field VS5 is a field by a fifth vertical synchronization signal. Fields VS1 to VS4 are repeated as one cycle TT. A symbol ○ denotes the electric power dispersion clamp while a symbol Δ denotes the electric power concentration clamp.

With regard to the X electrode X1, the electric power dispersion clamps are performed in the fields VS1 and VS4, and the electric power concentration clamps are performed in the fields VS2 and VS3, a proportion between the electric power dispersion clamp and the electric power concentration clamp being the same. With regard to the X electrode X2, the electric power concentration clamps are performed in the fields VS1 and VS4, and the electric power dispersion clamps are performed in the fields VS2 and VS3, the proportion between the electric power dispersion clamp and the electric power concentration clamp being the same. With regard to the Y electrode Y1, the electric power concentration clamps are performed in the fields VS1 and VS2, and the electric power dispersion clamps are performed in the fields VS3 and VS4, the proportion between the electric power dispersion clamp and the electric power concentration clamp being the same. With regard to the Y electrode Y2, the electric power dispersion clamps are performed in the fields VS1 and VS2, and the electric power concentration clamps are performed in the fields VS3 and VS4, the proportion between the electric power dispersion clamp and the electric power concentration clamp being the same.

According to the present embodiment, in the X electrode drive circuit and the Y electrode drive circuit, generation proportions between pulses by the electric power dispersion clamps and pulses by the electric power concentration clamps are the same. Hereby, the discharge variation can be prevented.

The electric power dispersion clamp and the electric power concentration clamp can be performed combinedly in the sub frame SF or the sub field in FIG. 20. For example, in a case that the number of the pulses in one sub frame SF is twenty, it is possible that the electric power dispersion clamps are performed for ten pulses and the electric power concentration clamps are performed for the other ten pulses.

As described above, the drive circuits according to the first to eleventh embodiments include clamp circuits which are connected to the power source potentials and in which there are selectively performed the electric power dispersion clamp where the electric potential of the capacitive load 120 is clamped to the power source potential such that the electric power is supplied to the capacitive load 120 in a temporally dispersed manner, and the electric power concentration clamp where the electric potential of the captive load 120 is clamped to the power source potential such that the electric power is supplied to the captive load 120 in a temporally concentrated manner. Here, in the present specification, the power source potential includes the power source potential Vs and the ground.

As described with reference to above FIG. 3, by differentiating turn-on times of the switches CU1 and CU2, a two-stage discharge clamp can be performed. A first stage discharge at the time t12 is an intermediate discharge by the electric power from the power source potential Vs, not by a weak electric power (energy) by the L-C resonance from the power recovery circuit, and a second stage discharge at the time t13 is a full discharge from the power source potential Vs. Additionally, by repeating the electric power dispersion clamp (two-stage discharge clamp) and the electric power concentration clamp (one-stage discharge clamp) in an appropriate cycle, the stability of the discharge can be obtained.

By the electric power dispersion clamp, discharge concentration is relaxed, so that the streaking is reduced. By the discharge of the clamp without depending on a coil (inductor), the discharge is stabilized, the pulse width can be reduced, and the luminance and tone scale can be improved.

Incidentally, in the first to the eleventh embodiments, though the switch CU is mainly described, the switch CD functions similarly. Though the Y electrode sustain circuit is mainly described, the X electrode sustain circuit functions similarly. The first to the eleventh embodiments can be variously combined. Though the plasma display device is described as an example of the display device, the embodiments can be applied to display devices other than the plasma display device using the capacitive load.

By supplying the electric power in a temporally dispersed manner, the discharge of the capacitive load can be temporally dispersed. Hereby, luminance deterioration can be prevented when the number of pixels to be displayed is large.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. The drive circuit of a display device using a capacitive load, comprising:

a clamp circuit connected to a power source potential and clamping a potential of the capacitive load to the power source potential such that an electric power is supplied to the capacitive load, wherein said clamp circuit selectively performs an electric power dispersion clamp in which the potential of the capacitive load is clamped to the power source potential such that the electric power is supplied to the capacitive load in a temporally dispersed manner, and an electric power concentration clamp in which the potential of the capacitive load is clamped to the power source potential such that the electric power is supplied to the capacitive load in a temporally concentrated manner, and said clamp circuit selects the electric power dispersion clamp or the electric power concentration clamp in accordance with a display ratio showing a proportion of a number of display pixels.

2. The drive circuit of a display device using a capacitive load, comprising:

a clamp circuit connected to a power source potential and clamping a potential of the capacitive load to the power source potential such that an electric power is supplied to the capacitive load, wherein said clamp circuit selectively performs an electric power dispersion clamp in which the potential of the capacitive load is clamped to the power source potential such that the electric power is supplied to the capacitive load in a temporally dispersed manner, and an electric power concentration clamp in which the potential of the capacitive load is clamped to the power source potential such that the electric power is supplied to the capacitive load in a temporally concentrated manner, said clamp circuit comprises a field-effect transistor connected between the capacitive load and the power source potential, wherein a gate resistance of the field-effect transistor is made comparatively large in the electric power dispersion clamp, the gate resistance of the field-effect transistor is made comparatively small in the electric power concentration clamp, and the gate resistance in the electric power dispersion clamp differs from the gate resistance in the electric power concentration clamp.

3. The drive circuit of a display device using a capacitive load, comprising:

a clamp circuit connected to a power source potential and clamping a potential of the capacitive load to the power source potential such that an electric power is supplied to the capacitive load, wherein said clamp circuit selectively performs an electric power dispersion clamp in which the potential of the capacitive load is clamped to the power source potential such that the electric power is supplied to the capacitive load in a temporally dispersed manner, and an electric power concentration clamp in which the potential of the capacitive load is clamped to the power source potential such that the electric power is supplied to the capacitive load in a temporally concentrated manner, said clamp circuit comprises a field-effect transistor connected between the capacitive load and the power source potential, a gate voltage of the field-effect transistor is changed between the electric power dispersion clamp and the electric power concentration clamp, in the electric power dispersion clamp, the gate voltage of the field-effect transistor is made comparatively low, and in the electric power concentration clamp, the gate voltage of the field-effect transistor is made higher than in the electric power dispersion clamp.

4. A drive circuit of a display device displaying by using a capacitive load, comprising:

a plurality of switches connected in parallel between the capacitive load and a same power source potential; and control means for controlling ON/OFF of the plurality of switches, wherein the control means supplies an electric power to the capacitive load, the control means controls so as to selectively perform an electric power dispersion clamp clamping a potential of the capacitive load to said same power source potential several times by turning ON the plurality of switches at different time and an electric power concentration clamp supplying the electric power to the capacitive load in a temporally concentrated manner by turning ON the plurality of switches simultaneously, and the control means controls so as to select the electric power concentration clamp when a display ratio is a first display ratio having a small display ratio, and select the electric power dispersion clamp when the display ratio is a second display ratio having a larger display ratio than the first display ratio.

* * * * *